US009789721B2

(12) United States Patent
Takano et al.

(10) Patent No.: US 9,789,721 B2
(45) Date of Patent: Oct. 17, 2017

(54) THERMOSENSITIVE RECORDING MEDIUM

(71) Applicant: OJI HOLDINGS CORPORATION, Tokyo (JP)

(72) Inventors: Suguru Takano, Tokyo (JP); Kazuo Yamane, Tokyo (JP); Naotaka Endo, Tokyo (JP); Kazuyuki Sakamoto, Tokyo (JP)

(73) Assignee: OJI HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 14/889,661

(22) PCT Filed: May 20, 2014

(86) PCT No.: PCT/JP2014/063335
§ 371 (c)(1),
(2) Date: Nov. 6, 2015

(87) PCT Pub. No.: WO2014/189044
PCT Pub. Date: Nov. 27, 2014

(65) Prior Publication Data

US 2016/0082760 A1 Mar. 24, 2016

(30) Foreign Application Priority Data

May 22, 2013 (JP) ..... 2013-107905
Jun. 5, 2013 (JP) ..... 2013-118407
Jun. 5, 2013 (JP) ..... 2013-118413

(51) Int. Cl.
*B41M 5/333* (2006.01)
*B41M 5/337* (2006.01)
*B41M 5/44* (2006.01)
*B41M 5/323* (2006.01)
*B41M 5/42* (2006.01)

(52) U.S. Cl.
CPC ..... *B41M 5/3336* (2013.01); *B41M 5/323* (2013.01); *B41M 5/3375* (2013.01); *B41M 5/42* (2013.01); *B41M 5/44* (2013.01); *B41M 5/423* (2013.01); *B41M 2205/04* (2013.01); *B41M 2205/38* (2013.01); *B41M 2205/40* (2013.01)

(58) Field of Classification Search
CPC .. B41M 5/333; B41M 5/3333; B41M 5/3335; B41M 5/3336; B41M 5/3337; B41M 5/337; B41M 5/3375; B41M 5/44; B41M 2205/04; B41M 2205/38; B41M 2205/40
USPC ..... 503/209, 216, 226
See application file for complete search history.

(56) References Cited

U.S. PATENT DOCUMENTS 6,921,740 B1 * 7/2005 Hizatate ..... B41M 5/3333 503/200
7,078,365 B2 7/2006 Kajikawa
2004/0171487 A1 9/2004 Kajikawa
2015/0284321 A1 10/2015 Sakai et al.

FOREIGN PATENT DOCUMENTS

EP 2957427 A1 12/2015
JP S56-5791 1/1981
JP S57-137185 8/1982
JP H11-268421 10/1999
JP H11-314457 11/1999
JP 2000-504722 4/2000
JP 2000-135868 5/2000
JP 2001-191643 A1 7/2001
JP 2001-341430 A 12/2001
JP 2003-326851 A 11/2003
JP 2004-223871 A1 8/2004
JP 2004-276593 A1 10/2004
(Continued)

OTHER PUBLICATIONS

International Search Report for International Application No. PCT/JP2014/063335 dated Aug. 26, 2014.
(Continued)

*Primary Examiner* — Bruce H Hess
(74) *Attorney, Agent, or Firm* — Kratz, Quintos & Hanson, LLP

(57) ABSTRACT

A primary object of the present invention is to provide a thermosensitive recording material that achieves high recording density and excellent preservability of a recorded part, or to provide a thermosensitive recording material that achieves high recording density, and excellent heat resistant and resistance to thermal background fogging property in a high temperature environment, as well as excellent sticking resistance and resistance to dirt adhesion of head.

The present invention is a thermosensitive recording material having a thermosensitive recording layer containing at least a leuco dye and a developer on a support; the thermosensitive recording material containing, as the developer, a sulfonamide compound represented by general formula (1); (a) the thermosensitive recording material further having a protective layer on the thermosensitive recording layer; the protective layer containing at least one type of adhesive agent selected from the group consisting of water soluble adhesive agents and water dispersible adhesive agents; and at least one of the thermosensitive recording layer or the protective layer containing a water resistance-imparting agent; or (b) the thermosensitive recording layer further containing saturated fatty acid amide represented by general formula (2).

13 Claims, No Drawings

(56) References Cited

FOREIGN PATENT DOCUMENTS

| | | | |
|---|---|---|---|
| JP | 2006-198781 | A1 | 8/2006 |
| JP | 2007-245379 | A1 | 9/2007 |
| JP | 2009-214422 | A1 | 9/2009 |
| JP | 2010-284939 | A1 | 12/2010 |
| WO | WO 97/29743 | A1 | 8/1997 |
| WO | WO 2009/122850 | A1 | 10/2009 |
| WO | WO 2014/080615 | A1 | 5/2014 |

OTHER PUBLICATIONS

Hatsumei Suishin Kyokai Kokai Giho (Journal of Technical Disclosure) No. 2012-504442, paragraphs [0158], [0214], with partial translation. Cited in the OA dated Feb. 9, 2016 for the corresponding JP patent application No. 2013-107905.

European Patent Application No. 14801765.0: Partial Supplementary European Search Report dated Mar. 17, 2017.

* cited by examiner

THERMOSENSITIVE RECORDING MEDIUM

TECHNICAL FIELD

The present invention relates to a thermosensitive recording material that utilizes a color-developing reaction between a leuco dye and developer.

BACKGROUND ART

Thermosensitive recording materials utilizing a color-developing reaction between a leuco dye and developer have been used not only as recording materials, such as papers for facsimile, cash registers, and various printers, but also in a wide variety of fields because such thermosensitive recording materials are relatively inexpensive, recording devices thereof are small in size, and maintenance of the recording devices is relatively easy.

As the fields of applications expand and as the recording devices have been diversified and achieved high performance, use environment and storage environment of recording materials have become increasingly severe, and thus more superior characteristics as well as excellent sensitivity and image quality of recorded image have been desired.

To date, as a technique to avoid decoloration of developed color image due to oils or plasticizers, a thermosensitive recording material containing a particular diphenyl sulfone-crosslinked compound as a developer (see Patent Document 1) has been proposed. Furthermore, for labels used for food products or test tubes in hospitals, since such labels may be brought into contact with alcohol having a high concentration, a thermosensitive recording material containing a particular urea urethane compound (see Patent Document 2) has been proposed to avoid decoloration due to such contact. However, these thermosensitive recording materials have problems of causing discoloration in the blank paper when stored for a long period of time (background fogging) although these thermosensitive recording materials can achieve high quality regarding preservability of its recorded part.

Furthermore, to suppress change of hue in the blank paper when the paper is stored for a long period of time, a thermosensitive recording material containing a diacetone-modified polyvinyl alcohol in an adhesive agent in a protective layer and a hydrazine-based compound in a thermosensitive recording layer (see Patent Document 3), and a thermosensitive recording material containing diacetone-modified polyvinyl alcohol and acrylic resin in an adhesive agent in a protective layer and a hydrazide compound in a protective layer (see Patent Document 4) have been proposed. However, to date, these thermosensitive recording materials are not always satisfactory regarding lowering of brightness although these thermosensitive recording materials are effective regarding yellowing of the blank paper.

Furthermore, as a technique to enhance water blocking properties, thermosensitive recording materials that use acetoacetyl-modified polyvinyl alcohol in a thermosensitive recording layer, that contain a (meth)acrylamide copolymer having a core-shell structure as a water dispersible resin in a protective layer, and that contain a crosslinking agent at least in the protective layer (see Patent Documents 5 and 6) have been proposed. Furthermore, a thermosensitive recording material containing a polyamide resin and a polycarboxylic acid dihydrazide compound in a thermosensitive recording layer and containing, as a water-based adhesive agent in a protective layer, at least one type selected from the group consisting of acetoacetyl-modified polyvinyl alcohol and diacetone-modified polyvinyl alcohol (see Patent Document 7) has been proposed. However, these thermosensitive recording materials cannot exhibit sufficient water blocking properties and have problems of worsening lowering of recording sensitivity and worsening yellowing of the blank paper when the amount of the crosslinking agent is increased to further enhance the water blocking properties.

Furthermore, as a technique to achieve higher image preservability, thermosensitive recording materials containing a particular diphenyl sulfone-crosslinked compound as a developer (see Patent Documents 1 and 8) have been proposed. However, these thermosensitive recording materials have problems of causing discoloration in the blank paper when stored for a long period of time (background fogging) although these thermosensitive recording materials can achieve high quality regarding preservability of its recorded part. Although the background fogging can be improved by using a color developer having a high melting point, the recording sensitivity is lowered thereby, and it is not possible to satisfy all the qualities.

Furthermore, since thermosensitive recording materials utilize a mechanism which develops color by melting a leuco dye and a color developer using heat and bringing them into contact, sticking, by which a component of a thermosensitive recording material melted using the heat attaches to a recording head and then the melt-attached part is forcibly peeled off by a feed roll, and sticking of dirt to a thermal head are easily caused.

To improve so-called head matching properties, including sticking and sticking of dirt to a thermal head, a technique of blending stearic acid amide and zinc stearate at a weight ratio in the range of 3:1 to 1:3 in a thermosensitive recording layer (see Patent Document 9), and a technique of blending higher fatty acid together with a metal salt of higher fatty acid in a thermosensitive recording layer (see Patent Document 10) have been also proposed. However, further improvements have been demanded to achieve reduction in power consumption of printers, lowering torque of paper feeders, and processing at a higher speed, for low-voltage printers such as mobile printers.

PRIOR ART DOCUMENT

Patent Document

Patent Document 1: Japanese Unexamined Patent Publication No. 2000-135868A

Patent Document 2: Japanese Unexamined Patent Publication No. 2004-223871A

Patent Document 3: Japanese Unexamined Patent Publication No. H11-314457A

Patent Document 4: Japanese Unexamined Patent Publication No. 2001-191643A

Patent Document 5: Japanese Unexamined Patent Publication No. 2006-198781A

Patent Document 6: Japanese Unexamined Patent Publication No. 2009-214422A

Patent Document 7: Japanese Unexamined Patent Publication No. 2007-245379A

Patent Document 8: Japanese Unexamined Patent Publication No. 2004-276593A

Patent Document 9: Japanese Unexamined Patent Publication No. S56-005791A

Patent Document 10: Japanese Unexamined Patent Publication No. S57-137185A

SUMMARY OF THE INVENTION

Problems to be Solved by the Invention

A primary object of the present invention is to provide a thermosensitive recording material of a first embodiment that achieves high recording density and excellent preservability of a recorded part, or to provide a thermosensitive recording material of a second embodiment that achieves high recording density, and excellent resistance to thermal background fogging property in a high-temperature environment, as well as excellent sticking resistance and dirt adhesion resistance of head.

Means to Solved the Problem

As a result of diligent research and considering the conventional technologies described above, the inventors of the present invention have solved the problems described above. That is, the present invention relates to a thermosensitive recording material described below.

Item 1: A thermosensitive recording material having a thermosensitive recording layer containing at least a leuco dye and a developer on a support; the thermosensitive recording material containing, as the developer, a sulfonamide compound represented by general formula (1) below:

[Formula 1]

(1)

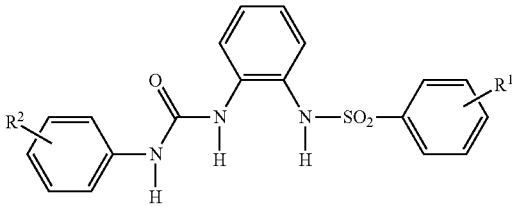

in formula (1), $R^1$ and $R^2$ may be the same or different and each independently represent a hydrogen atom, an alkyl group having from 1 to 4 carbons, an alkoxy group having from 1 to 4 carbons, or a halogen atom;

(a) the thermosensitive recording material further having a protective layer on the thermosensitive recording layer; the protective layer containing at least one type of adhesive agent selected from the group consisting of water soluble adhesive agents and water dispersible adhesive agents; and at least one of the thermosensitive recording layer or the protective layer containing a water resistance-imparting agent;

or (b) the thermosensitive recording layer further containing saturated fatty acid amide represented by general formula (2):

[Formula 2]

$$R—CONH_2 \quad (2)$$

in formula (2), R represents an alkyl group having from 15 to 21 carbons.

Item 2: The thermosensitive recording material according to Item 1, wherein the sulfonamide compound represented by general formula (1) is N-[2-(3-phenylureido)phenyl]benzenesulfonamide.

Item 3: The thermosensitive recording material according to Item 1 or 2, wherein the adhesive agent is at least one type selected from the group consisting of diacetone-modified polyvinyl alcohol, acetoacetyl-modified polyvinyl alcohol, carboxy-modified polyvinyl alcohol, acrylic resins, polyolefin resins, and (meth)acrylamide copolymers having a core-shell structure.

Item 4: The thermosensitive recording material according to any one of Items 1 to 3, wherein the adhesive agent is at least one type of modified polyvinyl alcohol selected from the group consisting of diacetone-modified polyvinyl alcohol and acetoacetyl-modified polyvinyl alcohol.

Item 5: The thermosensitive recording material according to any one of Items 1 to 4, wherein the thermosensitive recording layer further contains at least one type of sensitizer selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone.

Item 6: The thermosensitive recording material according to Item 4 or 5, wherein a degree of saponification of the modified polyvinyl alcohol is from 85 to 100 mol %.

Item 7: The thermosensitive recording material according to any one of Items 3 to 6, wherein the adhesive agent is diacetone-modified polyvinyl alcohol, and a degree of polymerization of the diacetone-modified polyvinyl alcohol is from 400 to 3000.

Item 8: The thermosensitive recording material according to any one of Items 3 to 6, wherein the adhesive agent is acetoacetyl-modified polyvinyl alcohol, and a degree of polymerization of the acetoacetyl-modified polyvinyl alcohol is from 500 to 3000.

Item 9: The thermosensitive recording material according to any one of Items 1 to 8, wherein the water resistance-imparting agent is a hydrazide compound.

Item 10: The thermosensitive recording material according to any one of Items 1 to 9, wherein the hydrazide compound is contained in the thermosensitive recording layer.

Item 11: The thermosensitive recording material according to any one of Items 5 to 10, wherein, per 1 part by mass of the saturated fatty acid amide, from 1 to 9 parts by mass of at least one type of sensitizer selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone is contained.

Item 12: The thermosensitive recording material according to any one of Items 1 to 11, wherein the saturated fatty acid amide is at least one type selected from the group consisting of palmitic acid amide, stearic acid amide, arachidic acid amide, and behenic acid amide.

Item 13: The thermosensitive recording material according to any one of Items 1 to 12, wherein the saturated fatty acid amide is stearic acid amide.

Item 14: The thermosensitive recording material according to any one of Items 1 to 13, further comprising an undercoat layer containing hollow plastic particles, the undercoat layer being arranged in between the support and the thermosensitive recording layer.

Item 15: The thermosensitive recording material according to any one of Items 1 to 14, further comprising an undercoat layer formed by a blade coating method, the undercoat layer being arranged in between the support and the thermosensitive recording layer.

Item 16: The thermosensitive recording material according to any one of Items 1 to 15, wherein at least one layer that is formed on the support is formed by a curtain coating method.

Item 17: A thermosensitive recording material having a thermosensitive recording layer containing at least a leuco dye and a developer on a support; the thermosensitive recording layer containing N-[2-(3-phenylureido)phenyl] benzenesulfonamide as the developer; the thermosensitive recording material further having a protective layer containing diacetone-modified polyvinyl alcohol as an adhesive agent on the thermosensitive recording layer; and at least one of the thermosensitive recording layer or the protective layer containing a water resistance-imparting agent.

Item 18: The thermosensitive recording material according to Item 17, wherein the thermosensitive recording layer further contains, as a sensitizer, at least one type selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone.

Item 19: The thermosensitive recording material according to Item 17 or 18, wherein a degree of saponification of the diacetone-modified polyvinyl alcohol is from 85 to 100 mol %.

Item 20: The thermosensitive recording material according to any one of Items 17 to 19, wherein a degree of polymerization of the diacetone-modified polyvinyl alcohol is from 400 to 3000.

Item 21: The thermosensitive recording material according to any one of Items 17 to 20, wherein the water resistance-imparting agent is a hydrazide compound.

Item 22: A thermosensitive recording material having a thermosensitive recording layer containing at least a leuco dye and a developer on a support; the thermosensitive recording layer containing N-[2-(3-phenylureido)phenyl] benzenesulfonamide as the developer; the thermosensitive recording material further having a protective layer containing acetoacetyl-modified polyvinyl alcohol as an adhesive agent on the thermosensitive recording layer; and at least one of the thermosensitive recording layer or the protective layer containing a water resistance-imparting agent.

Item 23: The thermosensitive recording material according to Item 22, wherein the thermosensitive recording layer further contains, as a sensitizer, at least one type selected from the group consisting of 2-naphthyl benzyl ether, di-p-chlorobenzyl oxalate, di-p-methylbenzyl oxalate, 1,2-di(3-methylphenoxy) ethane, 1,2-diphenoxyethane, and diphenyl sulfone.

Item 24: The thermosensitive recording material according to Item 22 or 23, wherein a degree of saponification of the acetoacetyl-modified polyvinyl alcohol is from 85 to 100 mol %.

Item 25: The thermosensitive recording material according to any one of Items 22 to 24, wherein a degree of polymerization of the acetoacetyl-modified polyvinyl alcohol is from 500 to 3000.

Item 26: The thermosensitive recording material according to any one of Items 22 to 25, wherein the water resistance-imparting agent is a hydrazide compound.

Item 27: The thermosensitive recording material according to any one of Items 22 to 26, wherein the hydrazide compound is contained in the thermosensitive recording layer.

Item 28: A thermosensitive recording material having a thermosensitive recording layer containing at least a leuco dye and a developer on a support; the thermosensitive recording material containing N-[2-(3-phenylureido) phenyl]benzenesulfonamide as the developer and further containing, as a sensitizer, at least one type selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone, and saturated fatty acid amide represented by general formula (2) below:

[Formula 3]

$$R—CONH_2 \quad (2)$$

in formula (2), R represents an alkyl group having from 15 to 21 carbons.

Item 29: The thermosensitive recording material according to Item 28, wherein, per 1 part by mass of the saturated fatty acid amide, from 1 to 9 parts by mass of at least one type selected from the group consisting of 2-naphthyl benzyl ether, di-p-chlorobenzyl oxalate, di-p-methylbenzyl oxalate, 1,2-di(3-methylphenoxy) ethane, 1,2-diphenoxyethane, and diphenyl sulfone is contained.

Item 30: The thermosensitive recording material according to Item 28 or 29, wherein the saturated fatty acid amide is at least one type selected from the group consisting of palmitic acid amide, stearic acid amide, arachidic acid amide, and behenic acid amide.

Item 31: The thermosensitive recording material according to any one of Items 28 to 30, wherein the saturated fatty acid amide is stearic acid amide.

Item 32: The thermosensitive recording material according to any one of Items 28 to 31, comprising an undercoat layer containing hollow plastic particles, the undercoat layer being arranged in between the support and the thermosensitive recording layer.

Item 33: The thermosensitive recording material according to any one of Items 28 to 32, comprising an undercoat layer formed by a blade coating method, the undercoat layer being arranged in between the support and the thermosensitive recording layer.

Item 34: The thermosensitive recording material according to any one of Items 28 to 33, where at least one layer that is formed on the support is formed by a curtain coating method.

Item 35: The thermosensitive recording material according to any one of Items 1 to 34, wherein a content of the sulfonamide compound represented by the general formula (1) is from 0.3 to 5 parts by mass per 1 part by mass of the leuco dye.

Effect of the Invention

The thermosensitive recording material of the first embodiment of the present invention achieves high recording density and excellent resistance to plasticizers of the recorded part.

Furthermore, the thermosensitive recording material of the second embodiment of the present invention achieves high recording density, and excellent resistance to thermal background fogging property in a high temperature environment, as well as excellent sticking resistance and dirt adhesion resistance of head.

BEST MODE FOR CARRYING OUT THE INVENTION

In the present specification, the expression "comprise" includes "comprise", "consisting essentially of", and "consisting of".

The present invention is to provide a thermosensitive recording material comprising, on a support: a thermosensitive recording layer containing at least a leuco dye and a particular developer, and a protective layer containing an adhesive agent, and the thermosensitive recording material contains a water resistance-imparting agent in at least one of the thermosensitive recording layer or the protective layer (hereinafter, also described as "thermosensitive recording material (a)"), or to provide a thermosensitive recording material comprising, on a support, a thermosensitive recording layer containing at least a leuco dye and a particular developer as well as a particular saturated fatty acid amide (hereinafter, also described as "thermosensitive recording material (b)"). Note that the layer structures of the thermosensitive recording materials (a) and (b) are not limited to the structures having a support and a thermosensitive recording layer, and a protective layer in the thermosensitive recording material (a). The layer structure also includes a structure having an undercoat layer in between the support and the thermosensitive recording layer, a structure having a back surface layer on a face that is the other side of the face having a thermosensitive recording layer of the support, and a structure in which the thermosensitive recording material (b) has a protective layer, and the like. The structures of the thermosensitive recording materials (a) and (b) will be described in detail below.

1. Thermosensitive Recording Material (a)

A thermosensitive recording material (a) of the present invention comprises, on a support, a thermosensitive recording layer containing at least a leuco dye and a particular developer, and a protective layer containing a particular adhesive agent, and contains a water resistance-imparting agent in at least one of the thermosensitive recording layer or the protective layer.

The support in the thermosensitive recording material (a) of the present invention is not particularly limited; however, examples thereof include neutral or acidic woodfree paper (neutral paper, acidic paper), art paper, synthetic paper, synthetic fiber paper, nonwoven medium-quality paper, coated paper, cast coated paper, glassine paper, resin laminated paper, polyolefin-based synthetic paper, transparent-, semitransparent-, or white-plastic films (synthetic resin films), and the like. Furthermore, as plastic films, examples include PET films and the like. The thickness of the support is not particularly limited; however, typically, the thickness is approximately from 20 to 200 μm.

The thermosensitive recording layer in the thermosensitive recording material (a) of the present invention may contain various publicly known leuco dyes having no color or pale color. Specific examples of the leuco dye include dyes capable of developing blue color, such as 3,3-bis(p-dimethylaminophenyl)-6-dimethylaminophthalide, 3-(4-diethylamino-2-methylphenyl)-3-(4-dimethylaminophenyl)-6-dimethylaminophthalide, and fluoran; dyes capable of developing green color, such as 3-(N-ethyl-N-p-tolyl)amino-7-N-methylanilinofluoran, 3-diethylamino-7-anilinofluoran, and 3-diethylamino-7-dibenzylaminofluoran; dyes capable of developing red color, such as 3,6-bis(diethylamino)fluoran-γ-anilinolactam, 3-cyclohexylamino-6-chlorofluoran, 3-diethylamino-6-methyl-7-chlorofluoran, and 3-diethylamino-7-chlorofluoran; dyes capable of developing black color, such as 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-diethylamino-7-(o-chlorophenylamino)fluoran, 3-(N-ethyl-p-toluidino)-6-methyl-7-anilinofluoran, 3-(N-ethyl-p-toluidino)-6-methyl-7-(p-toluidino)fluoran, 3-(N-ethyl-N-tetrahydrofurfurylamino)-6-methyl-7-anilinofluoran, 3-diethylamino-6-chloro-7-anilinofluoran, 3-dimethylamino-6-methyl-7-anilinofluoran, 3-pyrrolidino-6-methyl-7-anilinofluoran, 3-piperidino-6-methyl-7-anilinofluoran, 2,2-bis {4-[6'-(N-cyclohexyl-N-methylamino)-3'-methylspiro[phthalide-3,9'-xanthen-2'-ylamino]phenyl}propane, and 3-diethylamino-7-(3'-trifluoromethylphenyl)aminofluoran; dyes having an absorption wavelength in the near infrared region, such as 3,3-bis[1-(4-methoxyphenyl)-1-(4-dimethylaminophenyl)ethylen-2-yl]-4,5,6,7-tetrachlorophthalide, 3,3-bis[1-(4-methoxyphenyl)-1-(4-pyrrolidinophenyl)ethylen-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, and 3,6-bis(dimethylamino)fluorene-9-spiro-3'-(6'-dimethylamino)phthalide; and the like. The leuco dye is not limited to these and, as necessary, two or more types of leuco dyes may be used in combination. Among these, 3-di(n-butyl)amino-6-methyl-7-anilinofluoran, 3-di(n-pentyl)amino-6-methyl-7-anilinofluoran, and 3-(N-ethyl-N-isoamylamino)-6-methyl-7-anilinofluoran are preferably used due to excellent color development sensitivity and print preservability. The content of the leuco dye is approximately from 5 to 25% by mass, and preferably from 7 to 20% by mass, relative to the total solid content of the thermosensitive recording layer. By setting the content of the leuco dye to 5% by mass or greater, color developability can be enhanced to improve print density. Furthermore, by setting the content of the leuco dye to 25% by mass or less, heat resistance can be enhanced.

The thermosensitive recording layer in the thermosensitive recording material (a) of the present invention contains a sulfonamide compound represented by general formula (1) above (hereinafter, also referred to as "particular developer" or "particular sulfonamide compound") as the developer.

The thermosensitive recording layer in the thermosensitive recording material (a) of the present invention preferably contains N-[2-(3-phenylureido)phenyl]benzenesulfonamide as the specific developer. By this, high recording density and excellent image preservability, such as resistance to plasticizers, are achieved. Furthermore, when diacetone-modified polyvinyl alcohol is contained in the protective layer, it is possible to achieve excellent image preservability in terms of alcohol resistance and to maintain high brightness even after storage for a long period of time of at least one year or longer, in addition to the effects described above. Furthermore, when acetoacetyl-modified polyvinyl alcohol is contained in the protective layer, it is possible to achieve excellent water resistance and obtain an excellent thermosensitive recording material that causes less discoloration, caused by water and/or oil, of the recorded part, in addition to the effects described above.

The content of the particular developer in the thermosensitive recording layer is preferably 0.3 parts by mass or greater, more preferably 0.4 parts by mass or greater, even more preferably 0.5 parts by mass or greater, yet even more preferably 0.8 parts by mass or greater, yet even more preferably 1 part by mass or greater, and yet even more preferably 1.2 parts by mass or greater, per 1 part by mass of the leuco dye. By blending 0.3 parts by mass or greater of the particular developer per 1 part by mass of the leuco dye, recording density and resistance to plasticizers are enhanced. Furthermore, the content of the particular developer is preferably 5 parts by mass or less, more preferably 4 parts by mass or less, even more preferably 3.5 parts by mass or less, and particularly preferably 3 parts by mass or less, per 1 part by mass of the leuco dye. By compounding 5 parts by mass or less of the particular developer per 1 part by mass of the leuco dye, background fogging in a high temperature environment can be efficiently suppressed.

In particular, the range of the content of the particular developer in the thermosensitive recording layer of the thermosensitive recording material (a) is preferably from 0.5 to 5.0 parts by mass, more preferably from 0.8 to 4 parts by mass, even more preferably from 1 to 4 parts by mass, and particularly preferably from 1.2 to 3.5 parts by mass, per 1 part by mass of the leuco dye.

Although the developer of the present invention is a particular developer (preferably, N-[2-(3-phenylureido)phenyl]benzenesulfonamide), as necessary, various publicly known developers can be also used in combination in the range that does not cause troubles. Specific examples thereof include inorganic acidic substances such as activated clay, attapulgite, colloidal silica, and aluminum silicate; phenolic compounds such as 4,4'-isopropylidenediphenol, 1,1-bis(4-hydroxyphenyl)-1-phenylethane, 1,1-bis(4-hydroxyphenyl) cyclohexane, 2,2-bis(4-hydroxyphenyl)-4-methylpentane, 2,4'-dihydroxydiphenyl sulfone, 4,4'-dihydroxydiphenyl sulfide, hydroquinone monobenzyl ether, 4-hydroxy-4'-benzyloxydiphenyl sulfone, benzyl 4-hydroxybenzoate, 4,4'-dihydroxydiphenyl sulfone, 4-hydroxy-4'-isopropoxydiphenyl sulfone, bis(3-allyl-4-hydroxyphenyl)sulfone, 4-hydroxy-4'-methyldiphenyl sulfone, 4-allyloxy-4'-hydroxydiphenyl sulfone, and 3,4-dihydroxyphenyl-4'-methylphenylsulfone; thiourea compounds such as N,N'-di-m-chlorophenylthiourea; organic compounds having a —$SO_2NH$— bond in a molecule of p-cumylphenyl N-(p-toluenesulfonyl) carbamate, p-benzyloxyphenyl N-(p-toluenesulfonyl)carbamate, N-(o-toluoyl)-p-toluenesulfonamide, or similar molecules; aromatic carboxylic acids such as p-chlorobenzoic acid, 4-[2-(p-methoxyphenoxy)ethyloxy]salicylic acid, 4-[3-(p-tolylsulfonyl)propyloxy]salicylic acid, and 5-[p-(2-p-methoxyphenoxyethoxy)cumyl]salicylic acid; salts of these aromatic carboxylic acids with polyvalent metals such as zinc, magnesium, aluminum, calcium, titanium, manganese, tin, and nickel; antipyrine complex of zinc thiocyanate; organic acidic substances such as a composite zinc salt of terephthalaldehydic acid and another aromatic carboxylic acid; sulfonylurea compounds such as 4,4'-bis(3-tosylureido)diphenylmethane, 1,5-(3-oxapentylene)-bis(3-(3'-(p-toluenesulfonyl)ureido)benzoate, 1-(4-butoxycarbonylphenyl)-3-tosylurea, N-p-toluenesulfonyl-N'-3-(p-toluenesulfonyloxy)phenylurea, N-(p-toluenesulfonyl)-N'-phenylurea, N-(p-toluenesulfonyl)-N'-p-tolylurea, 4,4'-bis(3-(tosyl)ureido)diphenyl ether, and 4,4'-bis(3-(tosyl) ureido)diphenylsulfone; diphenylsulfone derivatives represented by general formula (3) below:

[Formula 4]

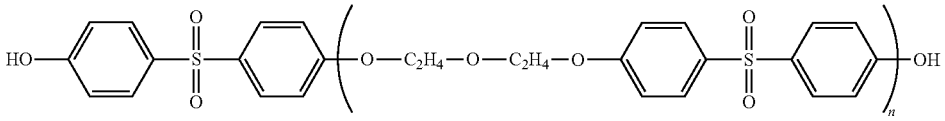

(3)

(in the formula, n is from 1 to 6);

ureaurethane derivatives represented by general formula (4) below:

[Formula 5]

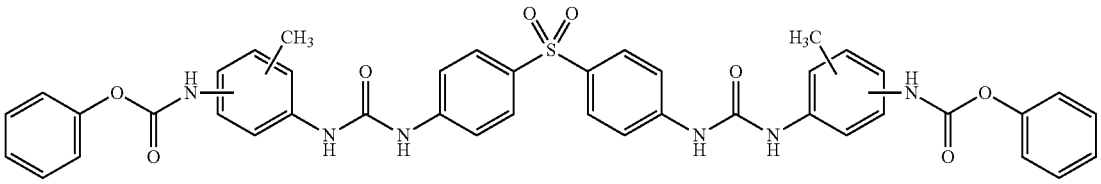

(4)

such as 4,4'-bis[(4-methyl-3-phenoxycarbonylaminophenyl)ureido]diphenylsulfone, 4,4'-bis[(2-methyl-5-phenoxycarbonylaminophenyl)ureido]diphenylsulfone, 4-(2-methyl-3-phenoxycarbonylaminophenyl)ureido-4'-(4-methyl-5-phenoxycarbonylaminophenyl)ureidodiphenylsulfone; and the like.

Among these, a combined use of 4,4'-bis(3-tosylureido) diphenylmethane, 1,5-(3-oxapentylene)-bis(3-(3'-(p-toluenesulfonyl)ureido)benzoate, diphenylsulfone derivatives represented by general formula (3) above, ureaurethane derivatives represented by general formula (4) above, such as 4,4'-bis[(4-methyl-3-phenoxycarbonylaminophenyl) ureido]diphenylsulfone, 4,4'-bis[(2-methyl-5-phenoxycarbonylaminophenyl)ureido]diphenylsulfone, and 4-(2-methyl-3-phenoxycarbonylaminophenyl)ureido-4'-(4-methyl-5-phenoxycarbonylaminophenyl) ureidodiphenylsulfone), the like is preferably used from the perspective of excellent print preservability.

Note that the content of the other developer is preferably less than 50% by mass of the content of the particular developer.

In the thermosensitive recording layer of the present invention, a sensitizer may be contained. By this, recording sensitivity can be enhanced. Examples of the sensitizer include stearic acid amide, methoxycarbonyl-N-stearic acid benzamide, N-benzoyl stearic acid amide, N-eicosanoic acid amide, ethylenebisstearic acid amide, behenic acid amide, methylenebisstearic acid amide, N-methylol stearic acid amide, dibenzyl terephthalate, dimethyl terephthalate, dioctyl terephthalate, diphenyl sulfone, benzyl p-benzyloxybenzoate, phenyl 1-hydroxy-2-naphthoate, benzyl 2-naphthyl ether, m-terphenyl, p-benzylbiphenyl, di-p-chlorobenzyl oxalate, di-p-methylbenzyl oxalate, dibenzyl oxalate, p-tolyl biphenyl ether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy) ethane, 1,2-diphenoxyethane, 1-(4-methoxyphenoxy)-2-(3-methylphenoxy)ethane, p-methylthiophenylbenzylether, 1,4-di(phenylthio)butane, p-acetotoluidide, p-acetophenetidide, N-acetoacetyl-p-toluidine, 1,2-diphenoxymethylbenzene, di(β-biphenylethoxy)benzene, p-di(vinyloxyethoxy) benzene, 1-isopropylphenyl-2-phenylethane, and the like. These sensitizers may be used in combination in the range that does not cause troubles. The content of the sensitizer may be an effective amount for sensitization; however, typically, the content is preferably approximately from 2 to 40% by mass, and more preferably approximately from 5 to 25% by mass, relative to the total solid content of the thermosensitive recording layer.

In the thermosensitive recording material (a) of the present invention, the thermosensitive recording layer preferably contains, as a sensitizer, at least one type selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone. Although these sensitizers exhibit excellent sensitization effect for the particular developer and also exhibit excellent resistance to thermal background fogging property, sticking and/or dirt adhesion to head is readily caused.

In the thermosensitive recording material (a) of the present invention, by comprising a protective layer containing at least one type of adhesive agent, as the adhesive agent, selected from the group consisting of particular water soluble adhesive agents and water dispersible adhesive agents, and by allowing a water resistance-imparting agent to be contained in at least one of the thermosensitive recording layer or the protective layer, it is possible to enhance sticking resistance and/or dirt adhesion resistance of head. Furthermore, since excellent sensitization effect is exhibited, recording density, which is sufficient to compensate for the reduction in the recording sensitivity caused by a reaction of the water resistance-imparting agent with the adhesive agent, can be obtained.

In particular, when the adhesive agent is diacetone-modified polyvinyl alcohol, long term preservability of the blank paper can be enhanced in addition to the effects described above. Furthermore, when the adhesive agent is acetoacetyl-modified polyvinyl alcohol, water resistance of the recorded part and water blocking properties are enhanced in addition to the effects described above.

The thermosensitive recording material (a) of the present invention may further contain saturated fatty acid amide represented by general formula (2) above.

As the contents of the particular sensitizer and the saturated fatty acid amide represented by general formula (2) above in the present invention, the content of the particular sensitizer is preferably approximately from 1 to 9 parts by mass, more preferably from 1 to 7 parts by mass, and even more preferably from 1 to 5 parts by mass, per 1 part by mass of the saturated fatty acid amide. By this, the dirt adhesion resistance of head can be enhanced.

The total content of the particular sensitizer and the saturated fatty acid amide represented by general formula (2) above may be an effective amount to achieve sensitization effect; however, typically, the total content is preferably approximately from 2 to 40% by mass, more preferably approximately from 5 to 25% by mass, and even more preferably approximately from 8 to 20% by mass, relative to the total solid content of the thermosensitive recording layer.

The total content of the particular sensitizer and the saturated fatty acid amide represented by general formula (2) above is preferably from 0.2 to 4 parts by mass, more preferably from 0.3 to 3 parts by mass, and even more preferably from 0.4 to 2.5 parts by mass, per 1 part by mass of the leuco dye.

From the perspectives of sensitization effect and sticking resistance, and dirt adhesion resistance of head, the saturated fatty acid amide represented by general formula (2) above is preferably at least one type selected from the group consisting of palmitic acid amide, stearic acid amide, arachidic acid amide, and behenic acid amide, and more preferably stearic acid amide.

Various resins are typically used in a coating liquid for the thermosensitive recording layer as an adhesive agent (binder). Examples of such an adhesive agent include starches, hydroxyethyl cellulose, methyl cellulose, carboxymethyl cellulose, gelatin, casein, gum arabic, polyvinyl alcohol, carboxy-modified polyvinyl alcohol, acetoacetyl-modified polyvinyl alcohol, diacetone-modified polyvinyl alcohol, silica-modified polyvinyl alcohol, diisobutylene-maleic anhydride copolymer salts, styrene-maleic anhydride copolymer salts, ethylene-acrylic acid copolymer salts, styrene-acrylic acid copolymer salts, styrene-butadiene copolymers, urea resins, melamine resins, amide resins, polyurethane resins, and the like. At least one type of these is preferably contained at an amount in the range of approximately from 5 to 50% by mass, and more preferably approximately from 10 to 40% by mass, relative to the total solid content of the thermosensitive recording layer. Note that, when the medium of the coating liquid for the thermosensitive recording layer is water, a hydrophobic resin is used in a form of latex.

In the thermosensitive recording material (a) of the present invention, the thermosensitive recording layer may further contain a preservability improving agent and other various auxiliary agents in addition to the leuco dye, the particular developer, the sensitizer, and the adhesive agent (binder).

The thermosensitive recording layer in the thermosensitive recording material (a) of the present invention may contain a preservability improving agent. By this, preservability of the recorded part can be enhanced. Examples of the preservability improving agent include hindered phenol compounds such as 2,2'-methylenebis(4-methyl-6-tert-butylphenol), 2,2'-methylenebis(4-ethyl-6-tert-butylphenol), 2,2'-ethylidenebis(4,6-di-tert-butylphenol), 4,4'-thiobis(2-methyl-6-tert-butylphenol), 4,4'-butylidenebis(6-tert-butyl-m-cresol), 1-[α-methyl-α-(4'-hydroxyphenyl)ethyl]-4-[α',α'-bis(4"-hydroxyphenyl) ethyl]benzene, 1,1,3-tris(2-methyl-4-hydroxy-5-cyclohexylphenyl) butane, 1,1,3-tris(2-methyl-4-hydroxy-5-tert-butylphenyl)butane, tris(2,6-dimethyl-4-tert-butyl-3-hydroxybenzyl)isocyanurate, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, and 2,2-bis(4-hydroxy-3,5-dimethylphenyl)propane; epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac-type epoxy resins, phenol novolac-type epoxy resins, and bisphenol A-type epoxy resins; sodium salts or polyvalent metal salts of N,N'-di-2-naphthyl-p-phenylenediamine or 2,2'-methylenebis(4,6-di-tert-butylphenyl)phosphate; bis(4-ethyleneiminocarbonylaminophenyl)methane; and the like. The content of the preservability improving agent may be an effective amount for improving preservability; however, typically, the content is preferably approximately from 1 to 30% by mass, and more preferably approximately from 5 to 20% by mass, relative to the total solid content of the thermosensitive recording layer.

Examples of the auxiliary agent include dispersing agents such as sodium dioctylsulfosuccinate, sodium dodecylbenzene sulfonate, sodium lauryl alcohol sulfate, and metal salts of fatty acid; waxes such as zinc stearate, calcium stearate, polyethylene wax, carnauba wax, paraffin wax, and ester wax; water resistance-imparting agents such as hydrazide compounds including adipic acid dihydrazide and the like, glyoxal, boric acid, dialdehyde starch, methylolurea, glyoxylic acid salt, and epoxy-based compounds; antifoaming agents; coloring dyes; fluorescent dyes; pigments; and the like.

In the thermosensitive recording material (a) of the present invention, the thermosensitive recording layer may contain microparticulate pigments having high brightness and having an average particle size of 10 μm or less to enhance brightness of the thermosensitive recording layer and to enhance uniformity of an image. Specifically, for example, inorganic pigments, such as calcium carbonate, magnesium carbonate, kaolin, clay, talc, calcined kaolin, amorphous silica, diatomaceous earth, synthetic aluminum silicate, zinc oxide, titanium oxide, aluminum hydroxide, barium sulfate, and surface treated-calcium carbonate or silica; and organic pigments, such as urea-formalin resins, styrene-methacrylic acid copolymer resins, polystyrene resins, raw starch particles, can be used. The content of the pigments is preferably an amount that does not decrease color density, that is, 50% by mass or less relative to the total solid content of the thermosensitive recording layer.

The thermosensitive recording layer is formed by coating a coating liquid for the thermosensitive recording layer on a support in a manner that the coating amount is preferably approximately from 2 to 12 g/m$^2$, and more preferably approximately from 3 to 10 g/m$^2$, in terms of dry weight, and by drying. The coating liquid is prepared, for example, by using water as a dispersing medium, and by mixing and stirring a dispersion, in which the leuco dye, the particular developer, and as necessary the sensitizer and the preservability improving agent and the like are finely dispersed by subjecting these together or separately to treatment using a stirrer and/or pulverizer, such as a ball mill, attritor, and sand mill, to make the average particle size thereof to be 2 μm or less, and as necessary the pigment, the adhesive agent (binder), the auxiliary agent, and the water resistance-imparting agent when a water resistance-imparting agent is blended.

The thermosensitive recording material (a) of the present invention comprises a protective layer on the thermosensitive recording layer to improve preservability of the recorded image against chemicals such as plasticizers and oils or to improve recordability. The protective layer contains at least one type of adhesive agent selected from the group consisting of water soluble adhesive agents and water dispersible adhesive agents (hydrophobic adhesive agents).

Examples of the water soluble adhesive agent include modified polyvinyl alcohol such as polyvinyl alcohol, completely saponified polyvinyl alcohol, partially saponified polyvinyl alcohol, diacetone-modified polyvinyl alcohol, acetoacetyl-modified polyvinyl alcohol, carboxy-modified polyvinyl alcohol, and silica-modified polyvinyl alcohol; starches and derivatives thereof; cellulose derivatives such as hydroxyethyl cellulose, methoxy cellulose, carboxymethyl cellulose, hydroxypropylmethyl cellulose, methyl cellulose, and ethyl cellulose; sodium polyacrylate, polyvinylpyrrolidone, acrylamide-acrylate copolymers, acrylamide-acrylate-methacrylic acid copolymers, alkali salts of styrene-maleic anhydride copolymer, polyacrylamide, sodium alginate, gelatin, casein, gum arabic, and the like.

Among these, diacetone-modified polyvinyl alcohol, acetoacetyl-modified polyvinyl alcohol, and carboxy-modified polyvinyl alcohol are preferable, and diacetone-modified polyvinyl alcohol and acetoacetyl-modified polyvinyl alcohol are more preferable.

Furthermore, examples of the water dispersible adhesive agent include acrylic resins such as polyacrylic acid, polyacrylate, and polybutylmethacrylate; polyolefin resins such as polyvinyl acetate, vinyl chloride-vinyl acetate copolymers, and ethylene-vinyl acetate copolymers; diene copolymers such as styrene-butadiene copolymers, styrene-butadiene-acrylonitrile copolymers, and acrylonitrile-butadiene copolymers; urethane resins such as polyurethane and silylated urethane; acryl-silicon composites; acryl-silicon-urethane composites; ionomer-type urethane resin latex, (meth) acrylamide copolymers having a core-shell structure, and the like. Among these, acrylic resins, polyolefin resins, (meth)acrylamide copolymers having a core-shell structure, and the like are preferable. Note that, when the medium of a coating liquid for the protective layer is water, the water dispersible adhesive agent is used in a form of latex. One type of these adhesive agents may be used alone, or two or more types of these adhesive agents may be used in combination. In this case, from the perspective of enhancing resistance to plasticizers, it is preferable not to contain the preferable adhesive agent described above and other water soluble adhesive agent; however, when these are contained, these are preferably used at an amount of less than 50% by mass of the amount of the preferable water soluble adhesive agent.

When the adhesive agent is modified polyvinyl alcohol, the degree of saponification of the modified polyvinyl alcohol is preferably approximately from 85 to 100 mol %, more preferably from 95 to 99 mol %, and most preferably from 98 to 99 mol %. By employing such a range, it is possible to exhibit good solubility to water and enhance water resistance when a water resistance-imparting agent is used together. In particular, when the modified polyvinyl alcohol is diacetone-modified polyvinyl alcohol, by setting the degree of saponification to be 85 mol % or greater, alcohol resistance can be enhanced. Furthermore, when the modified polyvinyl alcohol is acetoacetyl-modified polyvinyl alcohol, by setting the degree of saponification to be 85 mol % or greater, water resistance and water blocking properties can be further enhanced.

When the adhesive agent used in the protective layer is modified polyvinyl alcohol, the degree of polymerization of the modified polyvinyl alcohol is preferably approximately from 300 to 3000, more preferably approximately from 400 to 3000, even more preferably approximately from 500 to 3000, and yet even more preferably approximately from 1500 to 2500.

Furthermore, when the modified polyvinyl alcohol is diacetone-modified polyvinyl alcohol, the degree of polymerization of the diacetone-modified polyvinyl alcohol is approximately from 400 to 3000, and preferably approximately from 1500 to 2500. By setting the degree of polymerization to be 400 or greater, sufficient surface strength can be achieved. Alcohol resistance and resistance to plasticizers can be also enhanced. Meanwhile, by setting the degree of polymerization to be 3000 or less, introduction of a modifying group upon synthesizing diacetone-modified polyvinyl alcohol becomes easier and it is possible to achieve stable quality. The diacetone-modified polyvinyl alcohol preferably contains approximately 0.5 to 10 mol % of diacetone modifying group. By containing 0.5 mol % or greater of the diacetone modifying group in polyvinyl alcohol, water resistance can be further enhanced. Meanwhile, by setting the modified amount of the diacetone modifying group to be 10 mol % or less, it is possible to enhance the solubility to water, form a uniform protective layer by enhancing the coatability of the coating liquid for the protective layer, and enhance barrier properties.

Furthermore, when the modified polyvinyl alcohol is acetoacetyl-modified polyvinyl alcohol, the degree of polymerization of the acetoacetyl-modified polyvinyl alcohol is approximately from 500 to 3000, and preferably approximately from 1500 to 2500. By setting the degree of polymerization to be 500 or greater, sufficient surface strength can be achieved. Resistance to plasticizers and water resistance can be also enhanced. Meanwhile, by setting the degree of polymerization to be 3000 or less, the viscosity of the coating liquid for the protective layer becomes suitable, thereby achieving stable quality. In the acetoacetyl-modified polyvinyl alcohol, the degree of acetoacetylation is preferably approximately from 0.5 to 10 mol %. By setting the degree of acetoacetylation to be 0.5 mol % or greater, water resistance can be further enhanced. Meanwhile, by setting the degree of acetoacetylation to be 10 mol % or less, it is possible to enhance the solubility to water, form a uniform protective layer by enhancing the coatability of the coating liquid for the protective layer, and enhance barrier properties.

From the perspective of enhancing resistance to plasticizers, water resistance, and water blocking properties, it is preferable not to contain other water soluble adhesive agents; however, when other water soluble adhesive agents are contained, such water soluble adhesive agents are preferably used at an amount less than 50% by mass of the amount of the acetoacetyl-modified polyvinyl alcohol.

From the perspective of enhancing water resistance, the protective layer preferably contains carboxy-modified polyvinyl alcohol as the water soluble adhesive agent. The carboxy-modified polyvinyl alcohol used in the present invention is a carboxy-modified polyvinyl alcohol in which a carboxy group is introduced to enhance reactivity to water soluble polymers. Examples thereof include reaction products of polyvinyl alcohol and polycarboxylic acid, such as fumaric acid, phthalic anhydride, mellitic anhydride, and itaconic anhydride, or ester compounds of these reaction products, or saponified products of copolymers of vinyl acetate and ethylenically unsaturated dicarboxylic acid, such as maleic acid, fumaric acid, itaconic acid, crotonic acid, acrylic acid, and methacrylic acid.

The degree of saponification of the carboxy-modified polyvinyl alcohol used in the protective layer is preferably 85 mol % or greater from the perspective of enhancing alcohol resistance. Meanwhile, the degree of polymerization is preferably 1500 or greater from the perspective of enhancing surface strength. The content of the diacetone-modified polyvinyl alcohol, acetoacetyl-modified polyvinyl alcohol, and carboxy-modified polyvinyl alcohol is not particularly limited; however, the content is preferably from 10 to 70% by mass, and more preferably from 30 to 60% by mass, relative to the total solid content of the protective layer.

Among the carboxy-modified polyvinyl alcohol, the protective layer preferably contains at least one type selected from the group consisting of itaconic acid-modified polyvinyl alcohol and maleic acid-modified polyvinyl alcohol from the perspectives of enhancing water resistance, resistance to plasticizers, and sticking resistance. The content of the carboxy group in the itaconic acid- or maleic acid-modified polyvinyl alcohol is preferably approximately from 1 to 10 mol %. By setting the content to be 1 mol % or greater, water resistance can be enhanced. Meanwhile, even if the content is greater than 10 mol %, since water resistance reaches highest possible degree and does not increase further, the content is preferably 10 mol % or less from the perspective of lowering cost. The degree of polymerization of the itaconic acid- or maleic acid-modified polyvinyl alcohol is preferably approximately from 300 to 3000, and more preferably from 500 to 2200. Furthermore, the degree of saponification is preferably 80% or greater.

The protective layer preferably contains a (meth)acrylamide copolymer having a core-shell structure as the water dispersible adhesive agent from the perspectives of enhancing water resistance, water blocking properties, and sticking resistance. The (meth)acrylamide copolymer having a core-shell structure is a copolymer that is obtained by subjecting (meth)acrylamide or (meth)acrylamide and, as necessary, an unsaturated monomer that is copolymerizable with the (meth)acrylamide to copolymerization in the presence of seed emulsion, which becomes the core particles.

The seed emulsion, which becomes the core particles, may be a publicly known seed emulsion or a seed emulsion that is polymerized by a publicly known method. Examples thereof include (meth)acrylate-based, styrene-butadiene-based, styrene-(meth)acrylate-based, (meth)acrylate-butadiene-based, (meth)acrylonitrile-based, (meth)acrylonitrile-butadiene-based, vinyl chloride-based, and vinyl acetate-based emulsions, and the like. However, the seed emulsion is not limited to these, and typical polymer emulsions can be also used. One type of these emulsions may be used alone, or two or more types of these emulsions may be used in combination.

Examples of the unsaturated monomer that is copolymerizable with the (meth)acrylamide, which is used as necessary in the thermosensitive recording material (a) of the present invention, include unsaturated carboxylic acids such as (meth)acrylic acid, itaconic acid, maleic anhydride, fumaric acid, and crotonic acid; aromatic vinyl monomers such as styrene, α-methylstyrene, and divinylbenzene; (meth)acrylates such as methyl (meth)acrylate, ethyl (meth)acrylate, butyl (meth)acrylate, 2-ethylhexyl (meth)acrylate, 2-hydroxyethyl (meth)acrylate, 2-hydroxypropyl (meth)acrylate, 2-aminoethyl (meth)acrylate, 2-(N-methylamino)ethyl (meth)acrylate, and glycidyl (meth)acrylate; N-substituted unsaturated carboxylic acid amides such as N-methylol (meth)acrylic acid amide; vinyl esters such as vinyl acetate and propionic acid; nitrile group-containing monomers such as (meth)acrylonitrile; however, the unsaturated monomer is not limited to these.

In the (meth)acryl amide polymer having a core-shell structure, which is used in the thermosensitive recording material (a) of the present invention, the content of the (meth)acrylamide or the (meth)acrylamide and, as necessary, the unsaturated monomer that is copolymerizable with the (meth)acrylamide is preferably approximately from 5 to 500 parts by mass, and more preferably from 10 to 200 parts by mass, per 100 parts by mass of the seed emulsion, from the perspectives of further enhancing water resistance, water blocking properties, and sticking resistance.

The content of the (meth)acrylamide copolymer having a core-shell structure is not particularly limited; however, the content is preferably approximately from 10 to 70% by mass, and more preferably from 30 to 60% by mass, relative to the total solid content of the protective layer.

As the water resistance-imparting agent used in combination with the (meth)acrylamide copolymer having a core-shell structure, an epichlorohydrin resin is preferable. The content of the epichlorohydrin resin is preferably approximately from 1 to 100 parts by mass, more preferably from 5 to 80 parts by mass, and even more preferably from 10 to 70 parts by mass, per 100 parts by mass of the (meth) acrylamide copolymer having a core-shell structure. By setting the content to be 1 part by mass or greater, water resistance and water blocking properties can be enhanced. Meanwhile, by setting the content to be 100 parts by mass or less, a uniform coating layer can be obtained by suppressing increase in the viscosity or gelling of the coating liquid, and image uniformity can be enhanced.

From the perspective of enhancing water resistance, resistance to plasticizers, sticking resistance, and dirt adhesion resistance of head, the protective layer preferably contains at least one type selected from the group consisting of acrylic resins and polyolefin resins. These resins may be used as the water dispersible adhesive agent in a form of emulsion in the coating liquid for the protective layer.

As the polyolefin resin used in the thermosensitive recording material (a) of the present invention, an olefin-unsaturated carboxylic acid copolymer is preferable. As the olefin, ethylene, propylene, butylene, and the like are preferable, and ethylene is particularly preferable. As the unsaturated carboxylic acid, (meth)acrylic acid (i.e. acrylic acid or methacrylic acid), maleic acid, itaconic acid, fumaric acid, and the like are preferable, and (meth)acrylic acid is more preferable. As the olefin-unsaturated carboxylic acid copolymer, copolymers of ethylene and (meth)acrylic acid, or copolymers of propylene and (meth)acrylate copolymers are preferable.

The weight average molecular weight of the polyolefin resin is preferably from 5000 to 100000, and more preferably from 10000 to 50000. By setting the weight average molecular weight to be 5000 or greater, water blocking properties can be enhanced. Furthermore, by setting the weight average molecular weight to be 100000 or less, productivity can be enhanced.

The acrylic resin used in the thermosensitive recording material (a) of the present invention is formed from (meth) acrylic acid and a monomer component that is copolymerizable with the (meth)acrylic acid (except for olefin). The (meth)acrylic acid is preferably contained at an amount of 1 to 10 parts per 100 parts of the acrylic resin. The (meth) acrylic acid is soluble in alkali and has characteristics that makes acrylic resin to be a water-soluble resin upon addition of a neutralizer. By making the acrylic resin into a water-soluble resin, particularly when a pigment is contained in a protective layer, bonding property to pigments is significantly enhanced, and a protective layer having excellent strength can be formed even when a large amount of pigments is contained. Examples of the component that is copolymerizable with the (meth)acrylic acid include alkyl acrylate resins, such as methyl (meth)acrylate, ethyl (meth) acrylate, propyl (meth)acrylate, butyl (meth)acrylate, isobutyl (meth)acrylate, pentyl (meth)acrylate, hexyl (meth)acrylate, 2-ethylhexyl (meth)acrylate, and octyl (meth)acrylate; epoxy resins; silicone resins; modified alkyl acrylate resins of the above-described alkyl acrylate resins modified with styrene or derivatives thereof; (meth)acrylonitrile, acrylic acid esters, and hydroxyalkyl acrylic acid esters. In particular, (meth)acrylonitrile and/or methyl methacrylate is preferably contained. The (meth)acrylonitrile is preferably contained at an amount of 15 to 70 parts per 100 parts of the acrylic resin. Furthermore, the methyl methacrylate is preferably contained at an amount of 20 to 80 parts per 100 parts of the acrylic resin. When the (meth)acrylonitrile and the methyl methacrylate are contained, the (meth)acrylonitrile is preferably contained at an amount of 15 to 18 parts per 100 parts of the acrylic resin, and the methyl methacrylate is preferably contained at an amount of 20 to 80 parts per 100 parts of the acrylic resin.

The glass transition point (Tg) of the acrylic resin in the thermosensitive recording material (a) of the present invention is higher than 50° C. but 95° C. or lower. By setting the Tg to be higher than 50° C., sufficient heat resistance can be achieved and sticking resistance can be enhanced. Meanwhile, by setting the Tg to be 95° C. or lower, strength of the coated film of the protective layer can be enhanced, thereby enhancing barrier properties, such as water resistance, resistance to plasticizers, and resistance to solvents. Note that the Tg of the acrylic resin is measured by differential scanning calorimetry (DSC).

The acrylic resin used in the thermosensitive recording material (a) of the present invention is preferably a non-core-shell type acrylic resin. In general, core-shell type acrylic resins have superior heat resistance and sticking resistance compared to those of non-core-shell type acrylic resins. In the present invention, heat resistance, sticking resistance, and dirt adhesion resistance of head can be enhanced by using a non-core-shell type acrylic resin having the Tg of higher than 50° C. but 95° C. or lower.

The content of the polyolefin resin in the protective layer in the thermosensitive recording material (a) of the present invention is preferably approximately from 3 to 60% by mass, and more preferably from 5 to 30% by mass, relative to the total solid content of the protective layer. Meanwhile, the content of the acrylic resin is preferably approximately from 15 to 97% by mass, and more preferably from 40 to 95% by mass, relative to the total solid content of the protective layer. Furthermore, in the present invention, it is preferable to use the polyolefin resin and the acrylic resin in combination since the effect of the present invention can be fully exhibited. The mass ratio (solid content) of the polyolefin resin to the acrylic resin is preferably in the range of 3/97 to 50/50, and more preferably in the range of 5/95 to 40/60. For cases where the polyolefin resin and the acrylic resin are used in combination, the total content of the polyolefin resin and the acrylic resin in the protective layer is preferably approximately from 20 to 95% by mass, and more preferably from 40 to 80% by mass, relative to the total solid content of the protective layer.

The protective layer in the thermosensitive recording material (a) of the present invention may also contain a pigment. Examples of the pigment include inorganic pigments such as (precipitated) calcium carbonate, zinc oxide, aluminum oxide, titanium oxide, amorphous silica, colloidal silica, silica microparticles, aluminum hydroxide, barium sulfate, talc, kaolin, clay, and calcined kaolin; styrene resin fillers, nylon resin fillers, urea-formalin resin fillers; and organic pigments such as poly(meth)acrylate resin fillers, and raw starch particles. Among these, kaolin or aluminum hydroxide is preferably used since decrease in barrier properties against chemicals such as plasticizers and oils is small and decrease in recording density is also small. The content of the pigment is not particularly limited; however, the content is preferably approximately from 5 to 70% by mass relative to the total solid content of the protective layer.

The protective layer is formed by coating and drying a coating liquid for the protective layer on the thermosensitive recording layer. The coating liquid is obtained by typically using water as a medium and by mixing an aqueous solution in which water soluble adhesive agent is dissolved and/or a water dispersion in which water dispersible adhesive agent is dispersed, and, as necessary, other auxiliary agents, such as adhesive agents, pigments, lubricants, and surfactants, and a water resistance-imparting agent when a water resistance-imparting agent is blended. The coated amount of the coating liquid for the protective layer is not particularly limited; however, in terms of dry weight, the amount is adjusted to the range of preferably approximately 0.1 to 15 $g/m^2$, and more preferably approximately 0.5 to 8 $g/m^2$.

The auxiliary agent used in the coating liquid for the protective layer can be suitably selected from auxiliary agents that are typically used. Examples of the auxiliary agent include surfactants, waxes, lubricants, water resistance-imparting agents, UV absorbing agents, antifoaming agents, fluorescent brightening agents, coloring dyes, and the like. Examples of the surfactant include fatty acid alkali metal salts such as sodium dioctylsulfosuccinate, sodium dodecylbenzenesulfonate, sodium lauryl alcohol sulfate salt, and sodium stearate; and fluorine-based surfactants; and the like. Examples of the wax include carnauba wax, paraffin wax, ester wax, polyethylene wax, and the like. Examples of the lubricant include fatty acid metal salts such as zinc stearate and calcium stearate; alkyl phosphate salts such as potassium stearyl phosphate; and the like.

In the thermosensitive recording material (a) of the present invention, at least one of the thermosensitive recording layer or the protective layer contains a water resistance-imparting agent. By this, a thermosensitive recording material having a layer containing a reaction product of the adhesive agent and the water resistance-imparting agent can be obtained. Furthermore, when a suitable sensitizer of the present invention is used, it is possible to achieve effects that enhance sticking resistance and dirt adhesion resistance of head, and thus it is preferable since the effect of the thermosensitive recording material (a) of the present invention can be fully exhibited. Such a water resistance-imparting agent can be contained in at least one of the thermosensitive recording layer or the protective layer by blending the water resistance-imparting agent into at least one of the coating liquid for the thermosensitive recording layer or the coating liquid for the protective layer.

Furthermore, when the adhesive agent is acetoacetyl-modified polyvinyl alcohol, a layer containing a reaction product of the acetoacetyl-modified polyvinyl alcohol and the water resistance-imparting agent can be effectively formed by arranging the thermosensitive recording layer and the protective layer, in which the acetoacetyl-modified polyvinyl alcohol is contained, to be adjacent to each other. By this, excellent resistance which inhibits discoloration due to water of the particular developer in the thermosensitive recording material (a) of the present invention can be exhibited, in addition to whitening of the recorded part due to the protective layer swelled with water can be inhibited. When at least one type selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone is used as the sensitizer in the thermosensitive recording material (a) of the present invention, since sensitization effect to the particular developer is excellent, recording density that is sufficient to prevent discoloration of the recorded part due to water can be achieved. Such a water resistance-imparting agent can be contained in at least one of the thermosensitive recording layer or the protective layer by blending the water resistance-imparting agent into the coating liquid for the thermosensitive recording layer or the coating liquid for the protective layer.

Furthermore, when the adhesive agent is diacetone-modified polyvinyl alcohol and a water resistance-imparting agent is contained in the thermosensitive recording layer, lowering of alcohol resistance and resistance to plasticizers can be suppressed. Furthermore, unevenness of the coating of the protective layer can be decreased to enhance image quality. On the other hand, when the water resistance-imparting agent is contained in the protective layer, effect of suppressing lowering of recording density can be achieved. The reaction product of the diacetone-modified polyvinyl alcohol and the water resistance-imparting agent can be effectively contained in both the thermosensitive recording layer and the protective layer by blending the water resistance-imparting agent in the thermosensitive recording layer and the protective layer, which is preferable. Furthermore, as necessary, the water resistance-imparting agent may be contained in a middle layer that may be formed in between the thermosensitive recording layer and the protective layer or in a top layer that may be formed on the protective layer.

The protective layer is formed by coating a coating liquid for the protective layer on the thermosensitive recording layer in a manner that the coating amount is preferably approximately from 0.5 to 15 $g/m^2$, and more preferably approximately from 1.0 to 8 $g/m^2$, in terms of dry weight, and by drying. The coating liquid for the protective layer is prepared, for example, by using water as a dispersing medium, and by mixing and stirring the adhesive agent (binder), the water resistance-imparting agent, the pigment, the auxiliary agent, and the like.

The protective layer may be formed by using at least one type of adhesive agent and various auxiliary agents without using a pigment, and the protective layer may be formed by using an adhesive agent and a pigment in combination. The content of the adhesive agent is not particularly limited; however, the content is preferably from 1 to 97% by mass relative to the total solid content of the protective layer. The lower limit thereof is more preferably 3% by mass or greater, even more preferably 10% by mass or greater, particularly preferably 15% by mass or greater, and most preferably 20% by mass or greater. Meanwhile, the upper limit thereof is more preferably 95% by mass or less, even more preferably 70% by mass or less, and particularly preferably 60% by mass or less. When the adhesive agent and the pigment are used in combination, the content of the adhesive agent is not particularly limited and can be suitably selected from a wide range; however, typically, the content of the adhesive agent is preferably approximately from 1 to 95% by mass, and more preferably approximately from 2 to 80% by mass, relative to the total solid content of the protective layer. Furthermore, the content of the pigment is not particularly limited and can be suitably selected from a wide range;

however, typically, the content of the pigment is preferably approximately from 1 to 95% by mass, and more preferably approximately from 2 to 90% by mass, relative to the total solid content of the protective layer.

In the thermosensitive recording material (a) of the present invention, by allowing the water resistance-imparting agent to be contained in at least one of the thermosensitive recording layer or the protective layer, the reaction product of the adhesive agent, particularly modified polyvinyl alcohol (preferably acetoacetyl-modified polyvinyl alcohol), in the thermosensitive recording layer and the water resistance-imparting agent can be effectively contained in both the thermosensitive recording layer and the protective layer to further enhance water blocking properties, which is preferable. Furthermore, as necessary, the water resistance-imparting agent may be contained in a middle layer that may be formed in between the thermosensitive recording layer and the protective layer or in a top layer that may be formed on the protective layer; however, from the perspective of enhancing water resistance, the water resistance-imparting agent is preferably contained in a layer that is adjacent to the thermosensitive recording layer.

Examples of the water resistance-imparting agent include glyoxal, formalin, glycine, glycidyl ester, glycidyl ether, dimethylolurea, ketene dimer, dialdehyde starch, melamine resins, polyamide resins, polyamine/polyamide resins, epichlorohydrin resins, polyamide-polyamine-epichlorohydrin resins, ketone-aldehyde resins, borax, boric acid, ammonium zirconium carbonate, epoxy-based compounds, hydrazide compounds, oxazoline group-containing compounds, glyoxylates such as sodium glyoxylate, calcium di(glyoxylate), and ammonium glyoxylate, and the like.

When the adhesive agent is carboxy-modified polyvinyl alcohol, at least one type selected from the group consisting of epichlorohydrin resins and modified polyamine/amide resins is preferable as the water resistance-imparting agent that is used in combination with the carboxy-modified polyvinyl alcohol. By this, effects of sticking resistance and dirt adhesion resistance of head become excellent.

Examples of the epichlorohydrin resin include polyamide epichlorohydrin resins, polyamine epichlorohydrin resins, polyamide-polyamine-epichlorohydrin resins, and the like. Furthermore, as the amine present in the main chain of the epichlorohydrin resin, primary to quaternary amines can be used without any particular limitations. Examples of the modified polyamine/amide resins include polyamide urea resins, polyethylene imines, polyalkylene polyamines, and the like.

When the adhesive agent is carboxy-modified polyvinyl alcohol, the total content of the epichlorohydrin resin and/or the modified polyamine/amide resin is preferably approximately from 1 to 100 parts by mass, more preferably from 10 to 80 parts by mass, and even more preferably from 25 to 70 parts by mass, per 100 parts by mass of the carboxy-modified polyvinyl alcohol. By setting the content to be 1 part by mass or greater, good water resistance can be achieved. Meanwhile, by setting the content to be 100 parts by mass or less, a uniform coating layer can be obtained by suppressing increase in the viscosity or gelling of the coating liquid, and image uniformity can be enhanced.

Among these water resistance-imparting agents, hydrazide compounds are preferable. The hydrazide compound is not particularly limited as long as the hydrazide compound has a hydrazide group. Specific examples thereof include hydrazine and monohydrates thereof, phenylhydrazine, methylhydrazine, ethylhydrazine, n-propylhydrazine, n-butylhydrazine, ethylene-1,2-dihydrazine, propylene-1,3-dihydrazine, butylene-1,4-dihydrazine, benzoic acid hydrazide, formic acid hydrazide, acetic acid hydrazide, propionic acid hydrazide, n-butyric acid hydrazide, isobutyric acid hydrazide, n-valeric acid hydrazide, isovaleric acid hydrazide, pivalic acid hydrazide, carbohydrazide, and adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide, polyacrylic acid hydrazide, and the like. These may be used alone or in a combination of two or more types.

Among these hydrazide compounds, dicarboxylic acid dihydrazides, such as adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide, are preferable. Taking effect of imparting water resistance, solubility to water, and safety into consideration, adipic acid dihydrazide is more preferable. Dicarboxylic acid dihydrazides having less than 4 carbons may color the unrecorded part of the thermosensitive recording material in red although such dicarboxylic acid dihydrazides enhances reactivity.

When the hydrazide compound is used as the water resistance-imparting agent, the hydrazide compound is preferably contained in the thermosensitive recording layer. Blending of the hydrazide compound in the protective layer may affect the pot life of the coating liquid for the protective layer depending on the used amount. As the water resistance-imparting agent used in the protective layer, a water resistance-imparting agent that does not affect the pot life of the coating liquid of the protective layer is preferably used. Specifically, for example, ammonium zirconium carbonate, epoxy-based compounds, oxazoline group-containing compounds, and the like are preferable.

The total amount of the water resistance-imparting agent contained in each layer is not particularly limited; however, the total amount is preferably from 1 to 100 parts by mass, more preferably approximately from 5 to 20 parts by mass, and even more preferably approximately from 7 to 15 parts by mass, per 100 parts by mass of the adhesive agent used in the protective layer. When the adhesive agent is diacetone-modified polyvinyl alcohol or acetoacetyl-modified polyvinyl alcohol, by setting the total amount of the water resistance-imparting agent to be 5% by mass or greater, sufficient water resistance and water blocking properties can be exhibited. Meanwhile, by setting the total amount of the water resistance-imparting agent to be 20% by mass or less, recording sensitivity can be enhanced to increase recording density.

The content of the hydrazide compound contained in the thermosensitive recording layer is preferably 10 parts by mass or less per 100 parts by mass of the adhesive agent. By setting the content of the hydrazide compound to be 10 parts by mass or less, recording sensitivity can be enhanced when the adhesive agent is acetoacetyl-modified polyvinyl alcohol. Furthermore, yellowing of the blank paper can be suppressed.

The content of the water resistance-imparting agent contained in the protective layer is preferably 10 parts by mass or less per 100 parts by mass of the adhesive agent. By setting the content of the hydrazide compound to be 10 parts by mass or less, pot life of the coating liquid for the protective layer can be improved and unevenness of the coating of the protective layer can be decreased when the adhesive agent is diacetone-modified polyvinyl alcohol.

By allowing the water resistance-imparting agent to be contained in the thermosensitive recording layer and a water soluble acidic compound to be contained in the protective layer, water resistance of the protective layer can be further enhanced. The content of such a water soluble acidic compound is not particularly limited; however, in the coating liquid, the water soluble acidic compound is preferably contained at an amount such that the pH of the coating liquid for the protective layer is in the range of 2 to 6. By setting the pH to be 2 or greater, abnormal thickening of the coating liquid can be suppressed, and occurrence of background fogging in the thermosensitive recording layer can be suppressed. Meanwhile, by setting the pH to be 6 or less, water resistance of the protective layer can be further enhanced. The pH of the coating liquid for the protective layer is more preferably from 3 to 5.

As the water soluble acidic compound, various publicly known organic or inorganic acids can be used. Examples of such compounds include inorganic acids such as hydrochloric acid, sulfuric acid, nitric acid, and phosphoric acid; and organic acids such as carboxylic acid, sulfonic acid, sulfinic acid, barbituric acid, and uric acid. Among these, water soluble carboxylic acid, i.e. a water soluble organic compound having a carboxy group, is preferable from the perspective of handling. Specific examples of the water soluble organic compound having a carboxy group include formic acid, acetic acid, propionic acid, butyric acid, valeric acid, caproic acid, oxalic acid, malonic acid, succinic acid, glutaric acid, adipic acid, pimelic acid, fumaric acid, maleic acid, tartaric acid, citric acid, lactic acid, benzoic acid, phthalic acid, benzene tricarboxylic acid, and the like.

In the coating liquid for the protective layer, as necessary, lubricants such as zinc stearate, calcium stearate, polyethylene wax, carnauba wax, paraffin wax, and ester wax; surfactants (dispersing agents, humectants) such as sodium dioctylsulfosuccinate; antifoaming agent; various auxiliary agents such as water soluble polyvalent metal salts such as potassium alum and aluminum acetate can be suitably added.

Furthermore, discoloration of recorded images and/or yellowing of the unprinted surface part due to exposure to light can be significantly suppressed when a microcapsule containing a UV absorbing agent that is liquid at normal temperature, such as 2-(2'-hydroxy-3'-dodecyl-5'-methylphenyl)benzotriazole, is contained in the protective layer, in a manner that the content of the UV absorbing agent is preferably approximately from 2 to 40% by mass, more preferably approximately from 2 to 35% by mass, and even more preferably approximately from 3 to 30% by mass, relative to the total solid content of the protective layer.

In the thermosensitive recording material (a) of the present invention, an undercoat layer may be contained. The undercoat layer preferably contains at least one type selected from organic pigments or inorganic pigments. By this, recording sensitivity and running properties of recording can be further enhanced.

As the inorganic pigment, from the perspectives of suppressing adhesion of dirt to a thermal head and sticking, an oil-absorbing inorganic pigment with the oil absorption of 70 mL/100 g or greater, and particularly approximately from 80 to 150 mL/100 g, is preferably used. Note that the oil absorption can be determined in accordance with the method of JIS K 5101.

Various oil-absorbing inorganic pigments can be used as the oil-absorbing inorganic pigment; however, examples thereof include calcined kaolin, aluminum oxide, magnesium carbonate, amorphous silica, precipitated calcium carbonate, talc, and the like. The average particle size of the primary particles of these oil-absorbing inorganic pigments is preferably approximately from 0.01 to 5 μm, and more preferably approximately from 0.02 to 3 μm. Furthermore, the proportion of the oil-absorbing inorganic pigment that is used can be suitably selected from a wide range; however, typically, the proportion is preferably approximately from 2 to 95% by mass, and more preferably approximately from 5 to 90% by mass, relative to the total solid content of the undercoat layer.

In the present invention, as the organic pigment used in the undercoat layer, for example, non-foaming hollow organic particles that have a shell of thermoplastic resin and that have a hollow shape having air inside (hollow plastic particles), or thermally expandable particles that contain a foaming agent with a low-boiling point solvent inside and that are foamed by heating is preferably used. By this, recording sensitivity can be enhanced. Furthermore, since the hollow organic particles (hollow plastic particles) remain on the support to form a uniform undercoat layer to enhance barrier properties, the developer is prevented to be brought into contact with alkaline fillers contained in a plasticizer or in neutral paper, thereby suppressing lowering of color developability.

As the hollow organic particles, conventionally known hollow organic particles, such as particles in which film material is formed from acrylic resin, styrene resin, or vinylidene chloride resin and which have hollowness of approximately 50 to 99%, are exemplified. Note that the hollowness is a value determined by $(d/D)\times100$. In the formula, d represents the inner diameter of the hollow organic particles, and D represents the outer diameter of the hollow organic particles. The average particle size of the hollow organic particles is approximately from 0.5 to 10 μm, more preferably approximately from 1 to 4 μm, and even more preferably approximately from 1 to 3 μm. By setting the average particle size to be 10 μm or less, good coatability can be achieved since such a particle size does not cause troubles such as streaks and scratches when the coating liquid for the undercoat layer is coated by a blade coating method. Furthermore, the proportion of the hollow organic particles that are used can be suitably selected from a wide range; however, typically, the proportion is preferably approximately from 2 to 90% by mass, and more preferably approximately from 5 to 70% by mass, relative to the total solid content of the undercoat layer.

When the oil-absorbing inorganic pigment and the hollow organic particles are used in combination, the oil-absorbing inorganic pigment and the hollow organic particles are used in the range described above, and the total amount of the oil-absorbing inorganic pigment and the hollow organic particles is preferably approximately from 5 to 90% by mass, more preferably approximately from 10 to 90% by mass, and even more preferably approximately from 10 to 80% by mass, relative to the total solid content of the undercoat layer.

The content of the hollow organic particles can be suitably selected from a wide range; however, typically, the content is preferably approximately from 2 to 90% by mass relative to the total solid content of the undercoat layer. From the perspectives of enhancing barrier properties and improving effect of color developability, the lower limit thereof is more preferably 5% by mass or greater, and even more preferably 10% by mass or greater. Meanwhile, from the perspective of suppressing adhesion of dirt to a thermal head, the upper limit thereof is more preferably 80% by mass or less, even more preferably 70% by mass or less, particularly preferably 60% by mass or less, and most preferably 50% by mass or less.

The undercoat layer is formed by coating, on the support, a coating liquid for the undercoat layer, the coating liquid being prepared by typically using water as a medium and by mixing the hollow organic particles, the oil-absorbing pigment, an adhesive agent, and an auxiliary agent, and by drying. The coated amount of the coating liquid for the undercoat layer is not particularly limited; however, in terms of dry weight, the amount is preferably approximately from 3 to 20 $g/m^{2'}$ and more preferably approximately from 5 to 12 $g/m^2$.

The adhesive agent used in the undercoat layer can be suitably selected from adhesive agents that can be used in the thermosensitive recording layer and the protective layer. In particular, from the perspective of enhancing strength of the coated film, oxidized starches, starch-vinyl acetate graft copolymers, polyvinyl alcohol, styrene-butadiene latex, and the like are preferable. The content of the adhesive agent can be suitably selected from a wide range; however, typically, the content is preferably approximately from 5 to 30% by mass, and more preferably approximately from 10 to 20% by mass, relative to the total solid content of the undercoat layer.

The undercoat layer is formed by coating, on the support, a coating liquid for the undercoat layer, the coating liquid being prepared by typically using water as a medium and by mixing the pigment, the adhesive agent, and an auxiliary agent, and by drying. The coated amount of the coating liquid for the undercoat layer is not particularly limited; however, in terms of dry weight, the amount is preferably approximately from 3 to 20 $g/m^{2'}$ and more preferably approximately from 5 to 12 $g/m^2$.

In the present invention, as necessary, a back surface layer containing a pigment and an adhesive agent as the main components can be provided on a face that is the other side of the face having a thermosensitive recording layer of the support. By this, preservability can be further enhanced, and curling suitability and/or running properties for printers can be enhanced. Furthermore, various publicly known techniques in the field of thermosensitive recording material production can be applied as necessary. For example, back surface of the thermosensitive recording material may be subjected to adhesive agent treatment to process it into an adhesive label, or a magnetic recording layer and/or a layer to be coated by printing as well as a thermal transfer recording layer and/or an ink jet recording layer can be provided.

The method of coating the coating liquids described above is not particularly limited. For example, any conventionally known coating methods, such as bar coating, air knife coating, vari-bar blade coating, pure blade coating, rod blade coating, short dwell coating, curtain coating, and die coating, can be employed. Furthermore, the layers may be formed by coating each of the coating liquids to each of the layers and then drying, or two or more layers may be coated with the separated same coating liquid. Furthermore, simultaneous multilayer coating, by which two or more layers are coated at the same time, may be performed.

As the coating method of the coating liquid for the undercoat layer, a blade coating method is preferable from the perspective of enhancing the surface properties of the undercoat layer. By this, a thermosensitive recording layer having a uniform thickness can be formed by allowing no unevenness on the support, thereby enhancing recording sensitivity. Furthermore, in terms of quality, since the surface smoothness of the undercoat layer is further enhanced, it is possible to perform a curtain coating method while coating uniformity of the coating liquid for the thermosensitive recording layer is enhanced, and thus possible to enhance barrier properties of the protective layer that is provided as necessary. The blade coating method is not limited to a coating method that uses a blade exemplified by a bevel type or bent type blade but also includes pure blade coating, rod blade method, Billblade method, and the like.

The thermosensitive recording layer and the protective layer are preferably formed by simultaneous multilayer coating using curtain coating or the like. By this, barrier properties of the protective layer can be enhanced by forming a uniform coating layer, and productivity can be also enhanced. The curtain coating is a method by which the coating liquid is flown down and dropped freely to coat the support without direct contact. Any publicly known curtain coating method, such as slide curtain method, couple curtain method, and twin curtain method, can be employed, and the curtain coating method is not particularly limited. Furthermore, as described in Japanese Unexamined Patent Application Publication No. 2006-247611A, a coating layer can be formed on an inclined surface by dispensing the coating liquid downward from curtain heads, and then the curtain layer can be transferred onto a web surface by forming a curtain of the coating liquid from a downward curtain guide part on the end part of the inclined surface. In the simultaneous multilayer coating, each of the layers may be formed by, after coating liquids are laminated, coating and then drying; or each of the layers may be formed by coating a coating liquid that forms the lower layer, coating a coating liquid that forms the upper layer on the coated surface of the lower layer while the coated surface of the lower layer is not dried and is in wet condition, and then drying.

In the present invention, at least one layer formed on the support is preferably a layer formed by the curtain coating method. By this, a layer having a uniform thickness can be formed, thereby recording sensitivity can be enhanced, and barrier properties against oils, plasticizers, alcohols, and the like can be enhanced. The curtain coating method is a method by which the coating liquid is flown down and dropped freely to coat the support without direct contact. Any publicly known curtain coating method, such as slide curtain method, couple curtain method, and twin curtain method, can be employed, and the curtain coating method is not particularly limited. With the curtain coating method, a layer having a more uniform thickness can be formed by performing simultaneous multilayer coating. In the simultaneous multilayer coating, each of the layers may be formed by, after coating liquids are laminated, coating and then drying; or each of the layers may be formed by coating a coating liquid that forms the lower layer, coating a coating liquid that forms the upper layer on the coated surface of the lower layer while the coated surface of the lower layer is not dried and is in wet condition, and then drying. In the present invention, an embodiment in which the thermosensitive recording layer and the protective layer are subjected to the simultaneous multilayer coating is preferable from the perspective of enhancing barrier properties.

In the thermosensitive recording material (a) of the present invention, from the perspectives of enhancing recording sensitivity and enhancing image uniformity, smoothing treatment is preferably performed by using a conventionally known method, such as super calender or soft calender, in any stage after each of the layers is formed or after all the layers are formed.

The thermosensitive recording material (a) of the present invention may be a multicolor thermosensitive recording material to further add value to the product. In general, a multicolor thermosensitive recording material is a thermosensitive recording material having a structure in which a high temperature color developing layer and a low temperature color developing layer, which develop colors that differ each other, are laminated sequentially on a support, and utilizes the difference of heating temperatures or difference of thermal energy. These multicolor thermosensitive recording materials are roughly classified into two types, which are decoloring type and color additive type. Furthermore, there are methods that use microcapsules and methods for producing a multicolor thermosensitive recording material by using composite particles formed from an organic polymer and a leuco dye.

2. Thermosensitive Recording Material (b)

The thermosensitive recording material (b) of the present invention is a thermosensitive recording material containing at least a leuco dye and a particular developer on a support, and the thermosensitive recording layer contains a particular saturated fatty acid amide represented by general formula (2). Note that the layer structure of the thermosensitive recording material is not limited to the structure having a support and a thermosensitive recording layer. The layer structure also includes a structure having an undercoat layer in between the support and the thermosensitive recording layer, a structure having a protective layer on the thermosensitive recording layer, a structure having a back surface layer on a face that is the other side of the face having a thermosensitive recording layer of the support, and the like.

As the support in the thermosensitive recording material (b) of the present invention, similar supports as those described in "1. Thermosensitive recording material (a)" above can be used.

The thermosensitive recording layer in the thermosensitive recording material (b) of the present invention may contain various publicly known leuco dyes having no color or pale color. Specific examples of the leuco dye include similar leuco dyes as those described in "1. Thermosensitive recording material (a)" above.

In the thermosensitive recording layer in the thermosensitive recording material (b) of the present invention, a sensitizer may be contained. Examples of the sensitizer include similar sensitizers as those described in "1. Thermosensitive recording material (a)" above. Among these, at least one type of sensitizer selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone is preferable.

As the contents of the particular sensitizer described above and the saturated fatty acid amide represented by general formula (2) above, the content of the particular sensitizer is preferably approximately from 1 to 9 parts by mass, more preferably from 1 to 7 parts by mass, and even more preferably from 1 to 5 parts by mass, per 1 part by mass of the saturated fatty acid amide. By this, the dirt adhesion resistance of head can be enhanced.

The total content of the particular sensitizer and the saturated fatty acid amide represented by general formula (2) above may be an effective amount to achieve sensitization effect; however, typically, the total content is preferably approximately from 2 to 40% by mass, more preferably approximately from 5 to 25% by mass, and even more preferably approximately from 8 to 20% by mass, relative to the total solid content of the thermosensitive recording layer.

The total content of the particular sensitizer and the saturated fatty acid amide represented by general formula (2) above is preferably from 0.2 to 4 parts by mass, more preferably from 0.3 to 3 parts by mass, and even more preferably from 0.4 to 2.5 parts by mass, per 1 part by mass of the leuco dye.

From the perspectives of sensitization effect and sticking resistance, and dirt adhesion resistance of head, the saturated fatty acid amide represented by general formula (2) above is preferably at least one type selected from the group consisting of palmitic acid amide, stearic acid amide, arachidic acid amide, and behenic acid amide, and more preferably stearic acid amide.

In the thermosensitive recording layer in the thermosensitive recording material (b) of the present invention, various publicly known sensitizers, other than the particular sensitizer described above, may also be contained as necessary in the range that does not cause troubles. By this, recording sensitivity can be enhanced. As the sensitizer, similar sensitizers as those described in "1. Thermosensitive recording material (a)" above can be used.

As the adhesive agent (binder) in the coating liquid for the thermosensitive recording layer, similar adhesive agents as those described in "1. Thermosensitive recording material (a)" above can be typically used. The content of the adhesive agent is preferably in the range of approximately from 5 to 50% by mass, and more preferably approximately from 10 to 40% by mass, relative to the total solid content of the thermosensitive recording layer.

In the thermosensitive recording material (b) of the present invention, the thermosensitive recording layer may further contain a preservability improving agent and other various auxiliary agents in addition to the particular developer, the leuco dye, the sensitizer, and the adhesive agent. As the preservability improving agent and other various auxiliary agents, similar preservability improving agents and other various auxiliary agents as those described in "1. Thermosensitive recording material (a)" above can be used.

The thermosensitive recording layer is formed by coating and drying, on the support, the coating liquid for the thermosensitive recording layer prepared by a similar method as those described in "1. Thermosensitive recording material (a)" above. Examples of the preferable coated amount of the coating liquid for the thermosensitive recording layer is similar coated amounts as those described in "1. Thermosensitive recording material (a)" above.

In the thermosensitive recording material (b) of the present invention, an undercoat layer is preferably arranged in between the support and the thermosensitive recording layer, and more preferably, hollow organic particles (hollow plastic particles) are contained in the undercoat layer. By this, recording sensitivity can be further enhanced. Furthermore, since the hollow plastic particles remain on the support to form a uniform undercoat layer to enhance barrier properties, the developer is prevented to be brought into contact with alkaline fillers contained in a plasticizer or in neutral paper, thereby suppressing lowering of color developability. As the hollow plastic particles, hollow plastic particles described in "1. Thermosensitive recording material (a)" above can be used.

In the thermosensitive recording material (b) of the present invention, in terms of quality, coating the undercoat layer by a blade coating method leads to further enhancement of the surface smoothness of the undercoat layer. Therefore, it becomes possible to perform curtain coating while coating uniformity of the coating liquid for the thermosensitive recording layer is enhanced, and thus it is preferable from the perspective of enabling enhancement of barrier properties of the protective layer that is provided as necessary. The content of the hollow organic particles can be set to the range described in "1. Thermosensitive recording material (a)" above.

From the perspective of enhancing the effect of suppressing adhesion of dirt to a thermal head, the undercoat layer preferably contains an oil-absorbing pigment. As the oil-absorbing pigment, similar oil-absorbing pigments as those described in "1. Thermosensitive recording material (a)" above can be used. Furthermore, when the oil-absorbing inorganic pigment and the hollow organic particles are used in combination, the total amount of the oil-absorbing inorganic pigment and the hollow organic particles can be set to the range described in "1. Thermosensitive recording material (a)" above.

The undercoat layer is formed by coating and drying, on the support, the coating liquid for the undercoat layer prepared by a similar method as those described in "1. Thermosensitive recording material (a)" above. Examples of the preferable coated amount of the coating liquid for the undercoat layer is similar coated amounts as those described in "1. Thermosensitive recording material (a)" above.

The adhesive agent can be suitably selected from the adhesive agents that can be used in the thermosensitive recording layer described in "1. Thermosensitive recording material (a)" above. The content of the adhesive agent can be set to the ranges of the content described in "1. Thermosensitive recording material (a)" above.

The thermosensitive recording material of the present invention preferably comprises a protective layer on the thermosensitive recording layer to improve preservability of the recorded image against chemicals such as plasticizers and oils or to improve recordability.

The protective layer is formed by coating a coating liquid for the protective layer on the thermosensitive recording layer in a manner that the coating amount is preferably approximately from 0.5 to 15 g/m$^2$, and more preferably approximately from 1.0 to 8 g/m$^2$, in terms of dry weight, and by drying. The coating liquid for the protective layer is prepared, for example, by using water as a dispersing medium, and by mixing and stirring the adhesive agent, the water resistance-imparting agent, the pigment, the auxiliary agent, and the like.

Specific examples of the adhesive agent include similar adhesive agents as the adhesive agents that can be used in the protective layer described in "1. Thermosensitive recording material (a)" above.

As the pigment contained in the protective layer, similar pigments as the pigments that can be used in the protective layer described in "1. Thermosensitive recording material (a)" above can be used.

In the coating liquid for the protective layer, as necessary, lubricants, surfactants (dispersing agents, humectants), antifoaming agents, and various auxiliary agents can be suitably added. Specific examples of these include similar substances as those that can be used in the protective layer described in "1. Thermosensitive recording material (a)" above. Furthermore, to further enhance water resistance, a water resistance-imparting agent can be used in combination. Specific examples of water resistance-imparting agent include similar water resistance-imparting agents as those that can be used in the protective layer described in "1. Thermosensitive recording material (a)" above.

Furthermore, microcapsules containing a UV absorbing agent that is liquid at normal temperature, such as 2-(2'-hydroxy-3'-dodecyl-5'-methylphenyl)benzotriazole, can be used in the protective layer. The content of the microcapsules can be set to the range described for the protective layer in "1. Thermosensitive recording material (a)" above.

In the present invention, as necessary, a back surface layer containing a pigment and a binder as the main components can be provided on a face that is the other side of the face having a thermosensitive recording layer of the support. Specific examples of the back surface layer include back surface layers described for the protective layer in "1. Thermosensitive recording material (a)" above.

The thermosensitive recording layer, and the undercoat layer, the protective layer, and the back surface layer, which are provided as necessary, are formed by a method such that the coating liquid for the undercoat layer is coated and dried on the support using a suitable coating method that is exemplified in "1. Thermosensitive recording material (a)" above, and thereafter, the coating liquid for the thermosensitive recording layer is coated and dried on the undercoat layer, and then the coating liquid for the protective layer is coated and dried, and the like.

As the forming method of the undercoat layer, methods that are exemplified in "1. Thermosensitive recording material (a)" above can be used; however, the undercoat layer is preferably a layer formed by the blade coating method. By this, a thermosensitive recording layer having a uniform thickness can be formed by allowing no unevenness on the support, thereby enhancing recording sensitivity.

In the present invention, at least one layer formed on the support is preferably a layer formed by the curtain coating method. By this, a layer having a uniform thickness can be formed, thereby recording sensitivity can be enhanced, and barrier properties against oils, plasticizers, alcohols, and the like can be enhanced. In the thermosensitive recording material (b) of the present invention, examples of the curtain coating method include those methods described in "1. Thermosensitive recording material (a)" above; however, an embodiment in which the thermosensitive recording layer and the protective layer are subjected to the simultaneous multilayer coating is preferable from the perspective of enhancing barrier properties.

In the present invention, from the perspectives of enhancing recording sensitivity and enhancing image uniformity, smoothing treatment is preferably performed by using a conventionally known method, such as super calender or soft calender, in any stage after each of the layers is formed or after all the layers are formed.

In the present invention, the thermosensitive recording material may be a multicolor thermosensitive recording material to further add value to the product. As the forming method of the multicolor thermosensitive recording material, similar methods as those described in "1. Thermosensitive recording material (a)" above can be used.

EXAMPLES

The present invention will be further described in detail using examples; however, the present invention is not limited to these. Note that, unless otherwise noted, "part" and "%" respectively represent "part by mass" and "% by mass".

Working Example 1a

Preparation of Coating Liquid for Undercoat Layer

A composition formed from 120 parts of hollow plastic particles dispersion (trade name: ROPAQUE SN-1055; hollowness: 55%; average particle size: 1.0 μm; manufactured by Dow Coating Materials; solid content concentration:

26.5% by mass), 110 parts of 50% aqueous dispersion (average particle size: 0.6 μm) of calcined kaolin (trade name: Ansilex; manufactured by BASF), 20 parts of styrene-butadiene latex (trade name: L-1571; manufactured by Asahi Kasei Chemicals Corporation; solid content concentration: 48% by mass), 50 parts of 10% aqueous solution of oxidized starch, and 20 parts of water was mixed and stirred to obtain a coating liquid for undercoat layer.

Preparation of Liquid A (Leuco Dye Dispersion)

A composition formed from 100 parts of 3-di(n-butyl) amino-6-methyl-7-anilinofluoran, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 0.5 μm to obtain a liquid A.

Preparation of Liquid B (Developer Dispersion)

A composition formed from 100 parts of N-[2-(3-phenylureido)phenyl]benzenesulfonamide, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid B.

Preparation of Liquid C (Sensitizer Dispersion)

A composition formed from 100 parts of 1,2-di(3-methylphenoxy)ethane, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid C.

Preparation of Coating Liquid for Thermosensitive Recording Layer

A composition formed from 25 parts of liquid A, 80 parts of liquid B, 35 parts of liquid C, 20 parts of 60% aqueous dispersion of kaolin (trade name: UW-90; manufactured by BASF), 15 parts of 60% aqueous dispersion of aluminum hydroxide (trade name: HIGILITE H42; manufactured by Showa Denko K.K.), 55 parts of 15% aqueous solution of completely saponified polyvinyl alcohol (trade name: PVA-124; degree of polymerization: 2400; degree of saponification: 98.0 to 99.0 mol %; manufactured by Kuraray Co., Ltd.), 10 parts of 30% aqueous dispersion of zinc stearate, 5 parts of 5% aqueous dispersion of natural fat- and oil-based antifoaming agent (trade name: Nopco 1407H; manufactured by San Nopco Ltd.), 5 parts of 10% aqueous solution of sodium dioctylsulfosuccinate (trade name: SN WET OT-70; manufactured by San Nopco Ltd.), 30 parts of 10% aqueous solution of adipic acid dihydrazide, and 60 parts of water was mixed and stirred to obtain a coating liquid for thermosensitive recording layer.

Preparation of Coating Liquid for Protective Layer

A composition formed from a dispersion obtained by dispersing 50 parts of kaolin (trade name: UW-90; manufactured by BASF) in 100 parts of water, 600 parts of 10% aqueous solution of diacetone-modified polyvinyl alcohol (trade name: DF-20; degree of polymerization: 2000; degree of saponification: 98.5 mol %; manufactured by Japan VAM & POVAL Co., Ltd.), 10 parts of 30% aqueous dispersion of zinc stearate, 10 parts of 10% aqueous solution of sodium dioctylsulfosuccinate (trade name: SN WET OT-70; manufactured by San Nopco Ltd.), and 20 parts of 10% aqueous solution of adipic acid dihydrazide was mixed and stirred to obtain a coating liquid for protective layer.

Production of Thermosensitive Recording Material

An undercoat layer was formed by coating the coating liquid for the undercoat layer on one face of woodfree paper having the basis weight of 60 g/m$^2$ using a blade coater in a manner that the coated amount after being dried was 6 g/m$^2$, and drying. Using the coating liquid for the thermosensitive recording layer and the coating liquid for the protective layer, a coating liquid film having, sequentially from the support side, the coating liquid for the thermosensitive recording layer and the coating liquid for the protective layer was formed by a slide hopper type curtain coating device, and simultaneous multilayer curtain coating was performed on the undercoat layer in the manner that the coated amount in terms of the solid content for the thermosensitive recording layer was 3.0 g/m$^2$, and the coated amount in terms of the solid content for the protective layer was 2.5 g/m$^2$. Thereafter, the layers were dried to form a thermosensitive recording layer and a protective layer. Furthermore, super calender treatment was performed to obtain a thermosensitive recording material.

Working Example 2a

A thermosensitive recording material was obtained in the same manner as in Working Example 1a except for using diacetone-modified polyvinyl alcohol (trade name: DF-10; degree of polymerization: 1000; degree of saponification: 98.5 mol %; manufactured by Japan VAM & POVAL Co., Ltd.) in place of diacetone-modified polyvinyl alcohol (trade name: DF-20; degree of polymerization: 2000; degree of saponification: 98.5 mol %; manufactured by Japan VAM & POVAL Co., Ltd.) in "preparation of coating liquid for protective layer" of Working Example 1a.

Working Example 3a

A thermosensitive recording material was obtained in the same manner as in Working Example 1a except for using diacetone-modified polyvinyl alcohol (trade name: DM-20; degree of polymerization: 2000; degree of saponification: 96.5 mol %; manufactured by Japan VAM & POVAL Co., Ltd.) in place of diacetone-modified polyvinyl alcohol (trade name: DF-20; degree of polymerization: 2000; degree of saponification: 98.5 mol %; manufactured by Japan VAM & POVAL Co., Ltd.) in "preparation of coating liquid for protective layer" of Working Example 1a.

Working Example 4a

A thermosensitive recording material was obtained in the same manner as in Working Example 1a except for changing the amount of 10% aqueous solution of adipic acid dihydrazide in "preparation of coating liquid for thermosensitive recording layer" of Working Example 1a from 30 parts to 50 parts, and for changing the amount of 10% aqueous solution of adipic acid dihydrazide in "preparation of coating liquid for protective layer" from 20 parts to 0 parts.

Working Example 5a

A thermosensitive recording material was obtained in the same manner as in Working Example 1a except for changing the amount of 10% aqueous solution of adipic acid dihydrazide in "preparation of coating liquid for thermosensitive recording layer" of Working Example 1a from 30 parts to 0 parts, and for changing the amount of 10% aqueous solution of adipic acid dihydrazide in "preparation of coating liquid for protective layer" from 20 parts to 50 parts.

Working Example 6a

A thermosensitive recording material was obtained in the same manner as in Working Example 1a except for using polyacrylic acid hydrazide (average molecular weight: 20000; degree of hydrazidation: 80%) in place of adipic acid dihydrazide in "preparation of coating liquid for thermosensitive recording layer" and "preparation of coating liquid for protective layer" of Working Example 1a.

Comparative Example 1a

A thermosensitive recording material was obtained in the same manner as in Working Example 1a except for using 4-hydroxy-4'-isopropoxydiphenyl sulfone (trade name: D-8; manufactured by Nippon Soda Co., Ltd.) in place of N-[2-(3-phenylureido)phenyl]benzenesulfonamide in "preparation of liquid B" of Working Example 1a.

Comparative Example 2a

A thermosensitive recording material was obtained in the same manner as in Working Example 1a except for using 4,4'-dihydroxydiphenyl sulfone (trade name: BPS-P(T); manufactured by Nicca Chemical Co., Ltd.) in place of N-[2-(3-phenylureido)phenyl]benzenesulfonamide in "preparation of liquid B" of Working Example 1a.

Comparative Example 3a

A thermosensitive recording material was obtained in the same manner as in Working Example 1a except for using no adipic acid dihydrazide in "preparation of coating liquid for thermosensitive recording layer" and "preparation of coating liquid for protective layer" of Working Example 1a.

The following evaluations were performed for the thermosensitive recording materials obtained as described above. The results are shown in Table 1.

Recording Density

Each of the thermosensitive recording materials was printed using an applied energy of 0.28 mJ/dot by a thermosensitive recording tester (trade name: TH-PMH; manufactured by Ohkura Electric Co., Ltd.). The optical densities of the recorded part and the unrecorded part (unprinted surface part) were measured using the visual mode of a reflection densitometer (trade name: Macbeth Densitometer RD-918; manufactured by GretagMacbeth). Larger values indicate higher densities of the printing density. For the recorded part, practically, the value is preferably 1.20 or greater. On the other hand, the unprinted surface part preferably exhibits a smaller value, and preferably the value is 0.2 or less.

Resistance to Thermal Background Fogging Property

The optical density of the unprinted surface part after leaving each of the thermosensitive recording material prior to printing in a high temperature environment at 80° C. for 24 hours was measured using the visual mode of a reflection densitometer (trade name: Macbeth Densitometer RD-918; manufactured by GretagMacbeth). Smaller values are preferable, and preferably the value is 0.2 or less.

Alcohol Resistance

Each of the thermosensitive recording materials, in which color was developed for the recording density measurement, was immersed in a 20% ethanol solution for 10 minutes, and then dried. The optical density of the recorded part after the treatment was measured using the visual mode of a reflection densitometer (trade name: Macbeth Densitometer RD-918; manufactured by GretagMacbeth). Degree of preservability of the recorded part was also determined by the following formula. After the treatment, the recording density of 1.0 or greater and the degree of preservability of 60% or greater are preferable.

Degree of preservability (%)=(recording density after treatment/recording density before treatment)×100

Resistance to Plasticizers

A wrap film (trade name: Hi-S soft; manufactured by Nippon Carbide Industries Co., Inc.) was wrapped around a polycarbonate pipe (diameter: 40 mm) three times, the thermosensitive recording material, in which color was developed for the recording density measurement, was placed thereon, and then a wrap film was wrapped therearound three times. The assembly was left in an environment at 23° C. and 50% RH for 12 hours. The optical density of the recorded part after the treatment was measured using the visual mode of a reflection densitometer (trade name: Macbeth Densitometer RD-918; manufactured by GretagMacbeth). Degree of preservability of the recorded part was also determined by the following formula. After the treatment, the recording density of 1.0 or greater and the degree of preservability of 60% or greater are preferable.

Degree of preservability (%)=(recording density after treatment/recording density before treatment)×100

Long Term Preservability of Blank Paper

To evaluate the change in hue of the white part of the paper due to long term storage, before and after the thermosensitive recording material was stored in an environment at 40° C. and 90% RH for 7 days as the accelerated test, the L* value, a* value, b* value, and brightness of the white part of the paper (unprinted surface part) in illuminant C2 were measured by the Spectro Whiteness Colour Meter (trade name: SC-10WN; manufactured by Suga Test Instruments Co., Ltd.), and time-dependent change compared to the condition prior to the storage was evaluated based on the calculation formula described below.

$$\text{Change in hue } (\Delta E)=(\Delta L^2+\Delta a^2+\Delta b^2)^{1/2}$$

A: ΔE was less than 2.0, and almost no discoloration was observed.

B: ΔE was 2.0 or greater but less than 3.0, and slight discoloration was observed.

C: ΔE was 3.0 or greater but less than 4.0, and discoloration was observed.

D: ΔE was 4.0 or greater, and significant discoloration was practically problematic.

Sticking Resistance

Using a thermal printer (trade name: L'esprit T8; manufactured by Sato Corporation), a printing pattern of checkered pattern was developed on each of the thermosensitive recording materials at 2 inch/sec (density: 5A). Sound of printing was observed and print quality was visually observed to evaluate based on the following criteria.

A: No sound of printing was noticed, and the print quality had no problem.

B: Sound of printing was noticed, and a few chatter marks within the print was observed.

C: Sound of printing was large, and print quality was practically problematic with, for example, chatter marks within the print being present.

TABLE 1

| | | Resistance to thermal background | Alcohol resistance | | Resistance to plasticizers | |
|---|---|---|---|---|---|---|
| | Recording density | fogging property | Recording density | Degree of preservability | Recording density | Degree of preservability |
| Working Example 1a | 1.35 | 0.07 | 1.21 | 90% | 1.30 | 96% |
| Working Example 2a | 1.37 | 0.08 | 1.16 | 85% | 1.23 | 90% |
| Working Example 3a | 1.34 | 0.08 | 1.10 | 82% | 1.24 | 93% |
| Working Example 4a | 1.30 | 0.07 | 1.12 | 88% | 1.17 | 92% |
| Working Example 5a | 1.34 | 0.08 | 1.15 | 86% | 1.17 | 87% |
| Working Example 6a | 1.32 | 0.08 | 1.03 | 78% | 1.08 | 82% |
| Comparative Example 1a | 1.38 | 0.27 | 0.67 | 48% | 0.72 | 52% |
| Comparative Example 2a | 1.12 | 0.10 | 0.73 | 65% | 0.65 | 58% |
| Comparative Example 3a | 1.34 | 0.09 | 0.94 | 70% | 0.87 | 65% |

| | Long term preservability of blank paper | | | | |
|---|---|---|---|---|---|
| | Brightness | | Change in hue | | Sticking |
| | Before treatment | After treatment | ΔE | Evaluation | resistance |
| Working Example 1a | 92% | 89% | 1.7 | A | A |
| Working Example 2a | 91% | 88% | 1.8 | A | A |
| Working Example 3a | 92% | 85% | 1.7 | A | A |
| Working Example 4a | 92% | 86% | 1.6 | A | A |
| Working Example 5a | 92% | 87% | 1.6 | A | A |
| Working Example 6a | 92% | 84% | 1.8 | A | A |
| Comparative Example 1a | 88% | 72% | 4.8 | D | A |
| Comparative Example 2a | 85% | 65% | 6.7 | D | A |
| Comparative Example 3a | 90% | 82% | 2.5 | B | B |

Working Example 1b

Preparation of Coating Liquid for Undercoat Layer

A composition formed from 120 parts of hollow plastic particles dispersion (trade name: ROPAQUE SN-1055; hollowness: 55%; average particle size: 1.0 μm; manufactured by Dow Coating Materials; solid content concentration: 26.5% by mass), 110 parts of 50% aqueous dispersion (average particle size: 0.6 μm) of calcined kaolin (trade name: Ansilex; manufactured by BASF), 20 parts of styrene-butadiene latex (trade name: L-1571; manufactured by Asahi Kasei Chemicals Corporation; solid content concentration: 48% by mass), 50 parts of 10% aqueous solution of oxidized starch, and 20 parts of water was mixed and stirred to obtain a coating liquid for undercoat layer.

Preparation of Liquid A' (Leuco Dye Dispersion)

A composition formed from 100 parts of 3-di(n-butyl) amino-6-methyl-7-anilinofluoran, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 0.5 μm to obtain a liquid A'.

Preparation of Liquid B' (Developer Dispersion)

A composition formed from 100 parts of N-[2-(3-phenylureido)phenyl]benzenesulfonamide, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid B'.

Preparation of Liquid C' (Sensitizer Dispersion)

A composition formed from 100 parts of 1,2-di(3-methylphenoxy)ethane, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid C'.

Preparation of Coating Liquid for Thermosensitive Recording Layer

A composition formed from 25 parts of liquid A', 80 parts of liquid B', 35 parts of liquid C', 20 parts of 60% aqueous dispersion of kaolin (trade name: UW-90; manufactured by BASF), 15 parts of 60% aqueous dispersion of aluminum hydroxide (trade name: HIGILITE H42; manufactured by Showa Denko K.K.), 55 parts of 15% aqueous solution of completely saponified polyvinyl alcohol (trade name: PVA-124; degree of polymerization: 2400; degree of saponification: 98.0 to 99.0 mol %; manufactured by Kuraray Co., Ltd.), 10 parts of 30% aqueous dispersion of zinc stearate, 5 parts of 5% aqueous dispersion of natural fat- and oil-based antifoaming agent (trade name: Nopco 1407H; manufactured by San Nopco Ltd.), 5 parts of 10% aqueous solution of sodium dioctylsulfosuccinate (trade name: SN WET OT-70; manufactured by San Nopco Ltd.), 30 parts of 10% aqueous solution of adipic acid dihydrazide, and 60 parts of water was mixed and stirred to obtain a coating liquid for thermosensitive recording layer.

Preparation of Coating Liquid for Protective Layer

A composition formed from a dispersion obtained by dispersing 75 parts of kaolin (trade name: UW-90; manufactured by BASF) in 100 parts of water, 450 parts of 10% aqueous solution of acetoacetyl-modified polyvinyl alcohol (trade name: Gohsefimer Z-410; degree of polymerization: 2400; degree of saponification: 98.0 mol %; manufactured by The Nippon Synthetic Chemical Industry Co., Ltd.), 10 parts of 30% aqueous dispersion of zinc stearate, 10 parts of 10% aqueous solution of sodium dioctylsulfosuccinate (trade name: SN WET OT-70; manufactured by San Nopco Ltd.), and 2 parts of 45% aqueous solution of ammonium zirconium carbonate (trade name: Baycoat 20; manufactured by Nippon Light Metal Co., Ltd.) was mixed and stirred to obtain a coating liquid for protective layer.

Production of Thermosensitive Recording Material

An undercoat layer was formed by coating the coating liquid for the undercoat layer on one face of woodfree paper having the basis weight of 60 g/m$^2$ using a blade coater in a manner that the coated amount after being dried was 6 g/m$^2$, and drying. Using the coating liquid for the thermosensitive recording layer and the coating liquid for the protective layer, a coating liquid film having, sequentially from the support side, the coating liquid for the thermosensitive recording layer and the coating liquid for the protective layer was formed by a slide hopper type curtain coating device, and simultaneous multilayer curtain coating was performed on the undercoat layer in the manner that the coated amount in terms of the solid content for the thermosensitive recording layer was 3.0 g/m$^2$, and the coated amount in terms of the solid content for the protective layer was 2.5 g/m$^2$. Thereafter, the layers were dried to form a thermosensitive recording layer and a protective layer. Furthermore, super calender treatment was performed to obtain a thermosensitive recording material.

Working Example 2b

A thermosensitive recording material was obtained in the same manner as in Working Example 1b except for using acetoacetyl-modified polyvinyl alcohol (trade name: Gohsefimer Z-200; degree of polymerization: 1000; degree of saponification: 99.0 mol %; manufactured by The Nippon Synthetic Chemical Industry Co., Ltd.) in place of acetoacetyl-modified polyvinyl alcohol (trade name: Gohsefimer Z-410; degree of polymerization: 2400; degree of saponification: 98.0 mol %; manufactured by The Nippon Synthetic Chemical Industry Co., Ltd.) in "preparation of coating liquid for protective layer" of Working Example 1b.

Working Example 3b

A thermosensitive recording material was obtained in the same manner as in Working Example 1b except for using acetoacetyl-modified polyvinyl alcohol (trade name: Gohsefimer Z-320; degree of polymerization: 1700; degree of saponification: 93.0 mol %; manufactured by The Nippon Synthetic Chemical Industry Co., Ltd.) in place of acetoacetyl-modified polyvinyl alcohol (trade name: Gohsefimer Z-410; degree of polymerization: 2400; degree of saponification: 98.0 mol %; manufactured by The Nippon Synthetic Chemical Industry Co., Ltd.) in "preparation of coating liquid for protective layer" of Working Example 1b.

Working Example 4b

A thermosensitive recording material was obtained in the same manner as in Working Example 1b except for using no 45% aqueous solution of ammonium zirconium carbonate (trade name: Baycoat 20; manufactured by Nippon Light Metal Co., Ltd.) in "preparation of coating liquid for protective layer" of Working Example 1b.

Working Example 5b

A thermosensitive recording material was obtained in the same manner as in Working Example 1b except for using polyacrylic acid hydrazide (average molecular weight: 20000; degree of hydrazidation: 80%) in place of adipic acid dihydrazide in "preparation of coating liquid for thermosensitive recording layer" of Working Example 1b.

Comparative Example 1b

A thermosensitive recording material was obtained in the same manner as in Working Example 1b except for using 4-hydroxy-4'-isopropoxydiphenyl sulfone (trade name: D-8; manufactured by Nippon Soda Co., Ltd.) in place of N-[2-

(3-phenylureido)phenyl]benzenesulfonamide in "preparation of liquid B'" of Working Example 1b.

Comparative Example 2b

A thermosensitive recording material was obtained in the same manner as in Working Example 1b except for using 4,4'-dihydroxydiphenyl sulfone (trade name: BPS-P(T); manufactured by Nicca Chemical Co., Ltd.) in place of N-[2-(3-phenylureido)phenyl]benzenesulfonamide in "preparation of liquid B'" of Working Example 1b.

The following evaluations were performed for the thermosensitive recording materials obtained as described above. The results are shown in Table 2.

Recording Density

Each of the thermosensitive recording materials was printed using an applied energy of 0.28 mJ/dot by a thermosensitive recording tester (trade name: TH-PMH; manufactured by Ohkura Electric Co., Ltd.). The optical densities of the recorded part and the unrecorded part (unprinted surface part) were measured using the visual mode of a reflection densitometer (trade name: Macbeth Densitometer RD-918; manufactured by GretagMacbeth). Larger values indicate higher densities of the printing density. For the recorded part, practically, the value is preferably 1.20 or greater. On the other hand, the unprinted surface part preferably exhibits smaller value, and preferably the value is 0.2 or less.

Resistance to Plasticizers

A wrap film (trade name: Hi-S soft; manufactured by Nippon Carbide Industries Co., Inc.) was wrapped around a polycarbonate pipe (diameter: 40 mm) three times, the thermosensitive recording material, in which color was developed for the recording density measurement, was placed thereon, and then a wrap film was wrapped therearound three times. The assembly was left in an environment at 23° C. and 50% RH for 12 hours. The optical density of the recorded part after the treatment was measured using the visual mode of a reflection densitometer (trade name: Macbeth Densitometer RD-918; manufactured by GretagMacbeth). Degree of preservability of the recorded part was also determined by the following formula. After the treatment, the recording density of 1.0 or greater and the degree of preservability of 60% or greater are preferable.

Degree of preservability (%)=(recording density after treatment/recording density before treatment)×100

Water Resistance

Each of the thermosensitive recording materials, in which color was developed for the recording density measurement, was immersed in tap water at 20° C. for 24 hours, and then dried. The optical density of the recorded part after the treatment was measured using the visual mode of a reflection densitometer (trade name: Macbeth Densitometer RD-918; manufactured by GretagMacbeth). Degree of preservability of the recorded part was also determined by the following formula. After the treatment, the recording density of 1.0 or greater and the degree of preservability of 60% or greater are preferable.

Degree of preservability (%)=(recording density after treatment/recording density before treatment)×100

Water Blocking Properties

Two pieces of the thermosensitive recording material, obtained in Working Examples and Comparative Examples, were prepared. After 10 μL of water was dropped on a coated surface of the protective layer of one of the thermosensitive recording material, the thermosensitive recording material was placed on the other piece of the thermosensitive recording material in the manner that the coated surfaces of the protective layers were brought into contact each other. A load of 0.1 kg/cm$^2$ was applied thereto, and the evaluation sample was left in an environment at 40° C. and 90% RH for 24 hours. After the evaluation samples were removed, the evaluation samples were conditioned in an environment at 23° C. and 50% RH for 1 hour. Thereafter, the two pieces of the thermosensitive recording material were peeled off and the degree of adhesion was evaluated based on the following criteria.

A: No adhesion was observed.

B: Slight adhesion was observed.

C: Partial adhesion was observed but at a practical level.

D: Significant adhesion was observed and the adhesion was practically problematic.

TABLE 2

| | | Resistance to plasticizers | | Water resistance | | |
|---|---|---|---|---|---|---|
| | Recording density | Recording density | Degree of preservability | Recording density | Degree of preservability | Water blocking properties |
| Working Example 1b | 1.35 | 1.21 | 90% | 1.25 | 93% | A |
| Working Example 2b | 1.36 | 1.14 | 84% | 1.15 | 85% | A |
| Working Example 3b | 1.34 | 1.18 | 88% | 1.11 | 83% | B |
| Working Example 4b | 1.35 | 1.19 | 88% | 1.20 | 89% | B |
| Working Example 5b | 1.33 | 1.20 | 90% | 1.23 | 92% | A |
| Comparative Example 1b | 1.38 | 0.75 | 54% | 0.48 | 35% | A |
| Comparative Example 2b | 1.10 | 0.68 | 62% | 0.92 | 84% | A |

Working Example 1c

Preparation of Coating Liquid for Undercoat Layer

A composition formed from 120 parts of hollow plastic particles dispersion (trade name: ROPAQUE SN-1055; hollowness: 55%; average particle size: 1.0 μm; manufactured by Dow Coating Materials; solid content concentration: 26.5% by mass), 110 parts of 50% aqueous dispersion (average particle size: 0.6 μm) of calcined kaolin (trade name: Ansilex; manufactured by BASF), 20 parts of styrene-butadiene latex (trade name: L-1571; manufactured by Asahi Kasei Chemicals Corporation; solid content concentration: 48% by mass), 50 parts of 10% aqueous solution of oxidized starch, and 20 parts of water was mixed to obtain a coating liquid for undercoat layer.

Preparation of Liquid A" (Leuco Dye Dispersion)

A composition formed from 100 parts of 3-di(n-butyl) amino-6-methyl-7-anilinofluoran, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 0.5 μm to obtain a liquid A".

Preparation of Liquid B" (Developer Dispersion)

A composition formed from 100 parts of N-[2-(3-phenylureido)phenyl]benzenesulfonamide, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid B".

Preparation of Liquid C" (Sensitizer Dispersion)

A composition formed from 100 parts of 1,2-di(3-methylphenoxy)ethane, 50 parts of 20% aqueous solution of sulfone-modified polyvinyl alcohol (trade name: Gohseran L-3266; manufactured by The Nippon Synthetic Chemical Industry Co., Ltd.), 10 parts of 5% emulsion of natural fat- and oil-based antifoaming agent (trade name: Nopco 1407H; manufactured by San Nopco Ltd.), and 90 parts of water was pulverized using a sand mill until the median diameter measured by Laser Diffraction Particle Size Analyzer SALD-2200 (manufactured by Shimadzu Corporation) became 1.0 μm to obtain a liquid C".

Preparation of Liquid D (Sensitizer Dispersion)

A composition formed from 100 parts of stearic acid amide, 50 parts of 20% aqueous solution of sulfone-modified polyvinyl alcohol (trade name: Gohseran L-3266; described above), 2 parts of 5% emulsion of natural fat- and oil-based antifoaming agent (trade name: Nopco 1407H; manufactured by San Nopco Ltd.), and 98 parts of water was pulverized using a sand mill until the median diameter measured by Laser Diffraction Particle Size Analyzer SALD-2200 (manufactured by Shimadzu Corporation) became 1.0 μm to obtain a liquid D.

Preparation of Coating Liquid for Thermosensitive Recording Layer

A composition formed from 25 parts of liquid A", 45 parts of liquid B", 30 parts of liquid C", 15 parts of liquid D, 20 parts of aluminum hydroxide (trade name: HIGILITE H-42; average particle size: 1.0 μm; manufactured by Showa Denko K.K.), 10 parts of amorphous silica micropowder (trade name: MIZUKASIL P-605; average particle size: 3.0 μm; manufactured by Mizusawa Industrial Chemicals, Ltd.), 120 parts of 10% aqueous solution of starch-vinyl acetate graft copolymer (trade name: Petrocoat C-8; manufactured by Nippon Starch Chemical Co., Ltd.), 20 parts of 10% aqueous solution of completely saponified polyvinyl alcohol (trade name: Gohsenol NM-11; manufactured by The Nippon Synthetic Chemical Industry Co., Ltd.), 15 parts of zinc stearate dispersion (trade name: Hidorin Z-8-36; solid content concentration: 36%; manufactured by Chukyo Yushi Co., Ltd.), and 20 parts of water was mixed and stirred to obtain a coating liquid for thermosensitive recording layer.

Production of Thermosensitive Recording Material

An undercoat layer was formed by coating the coating liquid for the undercoat layer on one face of woodfree paper (acidic paper) having the basis weight of 53 g/m$^2$ as a support by the blade coating method using a blade coater in the manner that the weight after being dried was 5.5 g/m$^2$, and drying. After the coating liquid for the thermosensitive recording layer was coated on the undercoat layer by the curtain coating method using a slide hopper type curtain coating device, in the manner that the weight after being dried was 3.5 g/m$^2$ and dried, the layers were subjected to super calender treatment to obtain a thermosensitive recording material.

Working Example 2c

A thermosensitive recording material was obtained in the same manner as in Working Example 1c except for changing the amount of the liquid C" from 30 parts to 40 parts, and for changing the amount of the liquid D from 15 parts to 4.5 parts in "preparation of coating liquid for thermosensitive recording layer" of Working Example 1c.

Working Example 3c

A thermosensitive recording material was obtained in the same manner as in Working Example 1c except for changing the amount of the liquid C" from 30 parts to 23 parts, and for changing the amount of the liquid D from 15 parts to 22 parts in "preparation of coating liquid for thermosensitive recording layer" of Working Example 1c.

Working Example 4c

A thermosensitive recording material was obtained in the same manner as in Working Example 1c except for using di-p-methylbenzyl oxalate in place of 1,2-di(3-methylphenoxy)ethane in "preparation of liquid C"" of Working Example 1c.

Working Example 5c

A thermosensitive recording material was obtained in the same manner as in Working Example 1c except for using diphenyl sulfone in place of 1,2-di(3-methylphenoxy)ethane in "preparation of liquid C"" of Working Example 1c.

Working Example 6c

A thermosensitive recording material was obtained in the same manner as in Working Example 1c except for using palmitic acid amide in place of stearic acid amide in "preparation of liquid D" of Working Example 1c.

Working Example 7c

A thermosensitive recording material was obtained in the same manner as in Working Example 1c except for using arachidic acid amide in place of stearic acid amide in "preparation of liquid D" of Working Example 1c.

Comparative Example 1c

A thermosensitive recording material was obtained in the same manner as in Working Example 1c except for changing the amount of the liquid C" from 30 parts to 45 parts, and for using no liquid D in "preparation of coating liquid for thermosensitive recording layer" of Working Example 1c.

Comparative Example 2c

A thermosensitive recording material was obtained in the same manner as in Working Example 1c except for using oleic acid amide in place of stearic acid amide in "preparation of liquid D" of Working Example 1c.

Comparative Example 3c

A thermosensitive recording material was obtained in the same manner as in Working Example 1c except for using myristic acid amide in place of stearic acid amide in "preparation of liquid D" of Working Example 1c.

Comparative Example 4c

A thermosensitive recording material was obtained in the same manner as in Working Example 1c except for using lignoceric acid amide in place of stearic acid amide in "preparation of liquid D" of Working Example 1c.

Comparative Example 5c

A thermosensitive recording material was obtained in the same manner as in Working Example 1c except for using 4-hydroxy-4'-isopropoxydiphenyl sulfone (trade name: D-8; manufactured by Nippon Soda Co., Ltd.) in place of N-[2-(3-phenylureido)phenyl]benzenesulfonamide in "preparation of liquid B"" of Working Example 1c.

The following evaluations were performed for the thermosensitive recording materials obtained as described above. The results are shown in Table 3.

Recording Density

Each of the thermosensitive recording materials was printed using an applied energy of 0.17 mJ/dot and 0.28 mJ/dot by a thermosensitive recording tester (trade name: TH-PMH; manufactured by Ohkura Electric Co., Ltd.). The optical densities of the recorded parts were measured using the visual mode of a reflection densitometer (trade name: Macbeth Densitometer RD-918; manufactured by Gretag-Macbeth). Larger values indicate higher densities of the printing density. For the recorded parts, practically, the value for the case of the applied energy of 0.17 mJ/dot is preferably 0.90 or greater, and the value for the case of the applied energy of 0.28 mJ/dot is preferably 1.20 or greater.

Heat Resistance

The optical density of the unrecorded part (unprinted surface part) after leaving each of the thermosensitive recording material prior to printing in a high temperature environment at 80° C. for 2 hours was measured using the visual mode of a reflection densitometer (trade name: Macbeth Densitometer RD-918; manufactured by GretagMacbeth). Smaller values are preferable, and when the value exceeds 0.2, resistance to thermal background fogging property become problematic.

Resistance to Plasticizers

A wrap film (trade name: Hi-S soft; manufactured by Nippon Carbide Industries Co., Inc.) was wrapped around a polycarbonate pipe (diameter: 40 mm) three times, the thermosensitive recording material, in which color was developed for the recording density measurement, was placed thereon, and then a wrap film was wrapped therearound three times. The assembly was left in an environment at 20° C. and 65% RH for 12 hours. The optical density of the recorded part after the treatment was measured using the visual mode of a reflection densitometer (trade name: Macbeth Densitometer RD-918; manufactured by GretagMacbeth). Degree of preservability of the recorded part was also determined by the following formula. The recording density of 1.0 or greater and the degree of preservability of 60% or greater after the treatment do not cause problems.

Degree of preservability (%)=(recording density after treatment/recording density before treatment)×100

Sticking Resistance

Using a thermal printer (trade name: L'esprit T8; manufactured by Sato Corporation), a discretionary chosen printing pattern was developed on each of the thermosensitive recording materials at 2 inch/sec (density: 5A). Printing distance from the start of printing to the end of the printing was measured, and presence or absence of problems in print quality was visually observed to evaluate based on the following criteria.

A: The printing distance and the print quality had no problem.

B: The printing distance had no problem; however, the print quality was slightly inferior due to presence of chatter mark within the print but was not practically problematic.

C: The printing distance was shorter or longer than normal printing time, or print quality was practically problematic, such as chatter mark within the print was present.

Resistance to Dirt Adhesion of Head

Using a thermal printer (trade name: L'esprit T8; manufactured by Sato Corporation), each of the thermosensitive recording materials were developed for 90 cm at 4 inch/sec (density: 3A). Condition of dirt adhesion of the thermal head was visually observed to evaluate based on the following criteria.

A: No dirt adhesion was observed.

B: Slight dirt adhesion was observed at a level that does not practically cause any problems.

C: Dirt adhesion was observed at a level that practically causes problems.

TABLE 3

| | Recording density | | Heat resistance | Resistance to plasticizers | | | Resistance to |
|---|---|---|---|---|---|---|---|
| | 0.17 mJ/dot | 0.28 mJ/dot | Unprinted surface part | Recorded part | Degree of preservability | Sticking resistance | dirt adhesion of head |
| Working Example 1c | 1.10 | 1.35 | 0.12 | 1.23 | 91% | A | A |
| Working Example 2c | 1.10 | 1.35 | 0.11 | 1.23 | 91% | A | B |
| Working Example 3c | 1.08 | 1.34 | 0.12 | 1.21 | 90% | A | A |

TABLE 3-continued

| | Recording density | | Heat resistance | Resistance to plasticizers | | | Resistance to |
|---|---|---|---|---|---|---|---|
| | 0.17 mJ/dot | 0.28 mJ/dot | Unprinted surface part | Recorded part | Degree of preservability | Sticking resistance | dirt adhesion of head |
| Working Example 4c | 1.07 | 1.35 | 0.14 | 1.23 | 91% | A | A |
| Working Example 5c | 1.08 | 1.35 | 0.16 | 1.18 | 87% | A | A |
| Working Example 6c | 1.06 | 1.35 | 0.13 | 1.15 | 85% | B | A |
| Working Example 7c | 1.02 | 1.31 | 0.11 | 1.08 | 82% | A | A |
| Comparative Example 1c | 1.08 | 1.35 | 0.11 | 1.24 | 92% | C | B |
| Comparative Example 2c | 0.85 | 1.30 | 0.18 | 1.03 | 79% | B | C |
| Comparative Example 3c | 1.01 | 1.33 | 0.19 | 0.98 | 74% | C | B |
| Comparative Example 4c | 0.88 | 1.29 | 0.13 | 0.85 | 71% | A | B |
| Comparative Example 5c | 1.15 | 1.36 | 0.65 | 0.40 | 29% | A | A |

INDUSTRIAL APPLICABILITY

The thermosensitive recording material (a) of the present invention achieves high recording density and excellent preservability of the recorded part. Furthermore, by the adhesive agent used in the protective layer, it is also possible to achieve high brightness after long term storage, reduce change in hue, and/or enhance water resistance and water blocking properties. Therefore, the thermosensitive recording material (a) can be suitably used in receipts, labels for food products, various tickets, and the like.

The thermosensitive recording material (b) of the present invention achieves high recording density, causes no problems of background fogging even in a high temperature environment, and achieves excellent sticking resistance and resistance to dirt adhesion of head. Therefore, the thermosensitive recording material (b) is suitable as receipts, printing paper for ATM, various tickets, labels for food products or for test tubes, and the like.

What is claimed is:

1. A thermosensitive recording material having a thermosensitive recording layer containing at least a leuco dye and a developer on a support; the thermosensitive recording material containing, as the developer, a sulfonamide compound represented by general formula (1) below:

[Formula 1]

(1)

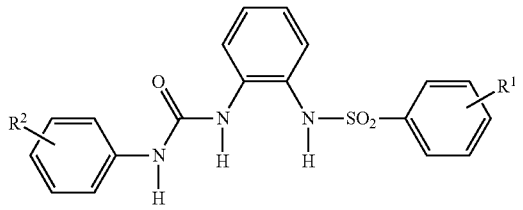

in formula (1), R1 and R2 may be the same or different and each independently represent a hydrogen atom, an alkyl group having from 1 to 4 carbons, an alkoxy group having from 1 to 4 carbons, or a halogen atom;

(a) the thermosensitive recording material further having a protective layer on the thermosensitive recording layer; the protective layer containing an adhesive agent; the adhesive agent being diacetone-modified polyvinyl alcohol; at least one of the thermosensitive recording layer or the protective layer containing a water resistance-imparting agent; and the water resistance-imparting agent being a hydrazide compound;

or (b) the thermosensitive recording layer further containing saturated fatty acid amide represented by general formula (2):

[Formula 2]

$$R—CONH_2 \quad (2)$$

in formula (2), R represents an alkyl group having from 15 to 21 carbons; and the thermosensitive recording layer further containing, as a sensitizer, from 1 to 9 parts by mass of 1,2-di(3-methylphenoxy)ethane per 1 part by mass of the saturated fatty acid amide.

2. The thermosensitive recording material according to claim 1, wherein the sulfonamide compound represented by general formula (1) is N-[2-(3-phenylureido)phenyl]benzenesulfonamide.

3. The thermosensitive recording material according to claim 1, wherein the thermosensitive recording layer (a) further contains at least one type of sensitizer selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone.

4. The thermosensitive recording material according to claim 3, wherein, per 1 part by mass of the saturated fatty acid amide, from 1 to 9 parts by mass of at least one type of sensitizer selected from the group consisting of 2-naphthyl benzyl ether, di-p-chlorobenzyl oxalate, di-p-methylbenzyl oxalate, 1,2-di(3-methylphenoxy)ethane, 1,2-diphenoxyethane, and diphenyl sulfone is contained.

5. The thermosensitive recording material according to claim 1, wherein a degree of saponification of the modified polyvinyl alcohol is from 85 to 100 mol%.

6. The thermosensitive recording material according to claim 1, wherein a degree of polymerization of the diacetone-modified polyvinyl alcohol is from 400 to 3000.

7. The thermosensitive recording material according to claim 1, wherein the hydrazide compound is contained in the thermosensitive recording layer.

8. The thermosensitive recording material according to claim 1, wherein the saturated fatty acid amide is at least one type selected from the group consisting of palmitic acid amide, stearic acid amide, arachidic acid amide, and behenic acid amide.

9. The thermosensitive recording material according to claim 1, wherein the saturated fatty acid amide is stearic acid amide.

10. The thermosensitive recording material according to claim 1, further comprising an undercoat layer containing hollow plastic particles, the undercoat layer being arranged in between the support and the thermosensitive recording layer.

11. The thermosensitive recording material according to claim 1, further comprising an undercoat layer formed by a blade coating method, the undercoat layer being arranged in between the support and the thermosensitive recording layer.

12. The thermosensitive recording material according to claim 1, wherein at least one layer that is formed on the support is formed by a curtain coating method.

13. The thermosensitive recording material according to claim 1, wherein a content of the sulfonamide compound represented by the general formula (1) is from 0.3 to 5 parts by mass per 1 part by mass of the leuco dye.

* * * * *